US012270269B2

(12) United States Patent
Tang et al.

(10) Patent No.: US 12,270,269 B2
(45) Date of Patent: Apr. 8, 2025

(54) TRANSMISSION DRIVE FOR DOWNHOLE TOOLS

(71) Applicant: Halliburton Energy Services, Inc., Houston, TX (US)

(72) Inventors: Shiao Loong Tang, Singapore (SG); Simon Whye Kwong Wai, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/364,192

(22) Filed: Aug. 2, 2023

(65) Prior Publication Data

US 2025/0043643 A1 Feb. 6, 2025

(51) Int. Cl.

| | |
|---|---|
| ***E21B 23/00*** | (2006.01) |
| ***E21B 4/00*** | (2006.01) |
| *E21B 23/04* | (2006.01) |

(52) U.S. Cl.

CPC ..... *E21B 23/001* (2020.05); *E21B 4/006* (2013.01); *E21B 23/042* (2020.05)

(58) Field of Classification Search

CPC ..... E21B 23/001; E21B 4/006; E21B 23/042; E21B 23/0421; E21B 23/0422

See application file for complete search history.

(56) References Cited

U.S. PATENT DOCUMENTS

| | | | | |
|---|---|---|---|---|
| 8,602,127 | B2 * | 12/2013 | Hummes | E21B 4/006 175/107 |
| 9,890,602 | B2 | 2/2018 | Guttormsen et al. | |
| 2008/0190665 | A1 | 8/2008 | Earles et al. | |
| 2009/0218105 | A1 * | 9/2009 | Hill | E21B 23/0411 166/241.1 |
| 2012/0160569 | A1 | 6/2012 | Hummes | |
| 2015/0300113 | A1 * | 10/2015 | Guttormsen | E21B 4/18 166/243 |
| 2019/0040698 | A1 | 2/2019 | Fuglestad | |
| 2019/0048976 | A1 | 2/2019 | Armstrong | |
| 2020/0157886 | A1 * | 5/2020 | Fuglestad | F16H 49/001 |

FOREIGN PATENT DOCUMENTS

| | | | | |
|---|---|---|---|---|
| CN | 107882520 A | * | 4/2018 | E21B 23/00 |

OTHER PUBLICATIONS

"PCT Application No. PCT/US2023/071604, International Search Report and Written Opinion", Apr. 30, 2024, 11 pages.

* cited by examiner

*Primary Examiner* — Robert E Fuller

(74) *Attorney, Agent, or Firm* — DeLizio, Peacock, Lewin & Guerra LLP

(57) ABSTRACT

Downhole tools for use in performing one or more operations in a wellbore include one cycloid drive or a plurality of cycloid drives coupled to the downhole tool, the cycloid drive(s) configured to operate the downhole tool when powered by an actuator device, such as an electric motor or some other actuator device capable of driving an input to the cycloid drive(s).

14 Claims, 13 Drawing Sheets

TRANSMISSION DRIVE FOR DOWNHOLE TOOLS

TECHNICAL FIELD

This disclosure relates generally to wellbore apparatus and methods configured to operate and/or to position downhole tools in a wellbore.

BACKGROUND

Hydrocarbons, such as oil and gas, are commonly obtained from subterranean formations that may be located onshore or offshore. The development of subterranean operations and the processes involved in removing hydrocarbons from a subterranean formation are complex. Typically, subterranean operations involve a number of different phases, such as, for example, drilling a wellbore at a desired well site, cementing the well, treating the wellbore to optimize production of hydrocarbons, and producing and processing the hydrocarbons from the subterranean formation for downstream use.

To obtain hydrocarbons such as oil and gas, boreholes are drilled by rotating a drill bit attached at a drill string end. A proportion of the current drilling activity involves directional drilling (e.g., drilling deviated and/or horizontal boreholes) to steer a well towards a target zone and increase hydrocarbon production from subterranean formations. Modern directional drilling systems generally employ a drill string having a bottom-hole assembly (BHA) and a drill bit situated at an end thereof that may be rotated by rotating the drill string from the surface, using a mud motor arranged downhole near the drill bit, or a combination of the mud motor and rotation of the drill string from the surface. Other operations performed in a wellbore environments involve use of a reciprocating downhole tool, and the use of apparatus to move and position downhole tools within a wellbore.

BRIEF DESCRIPTION OF THE DRAWINGS

Embodiments of the disclosure may be better understood by referencing the accompanying drawings.

Figure 1:
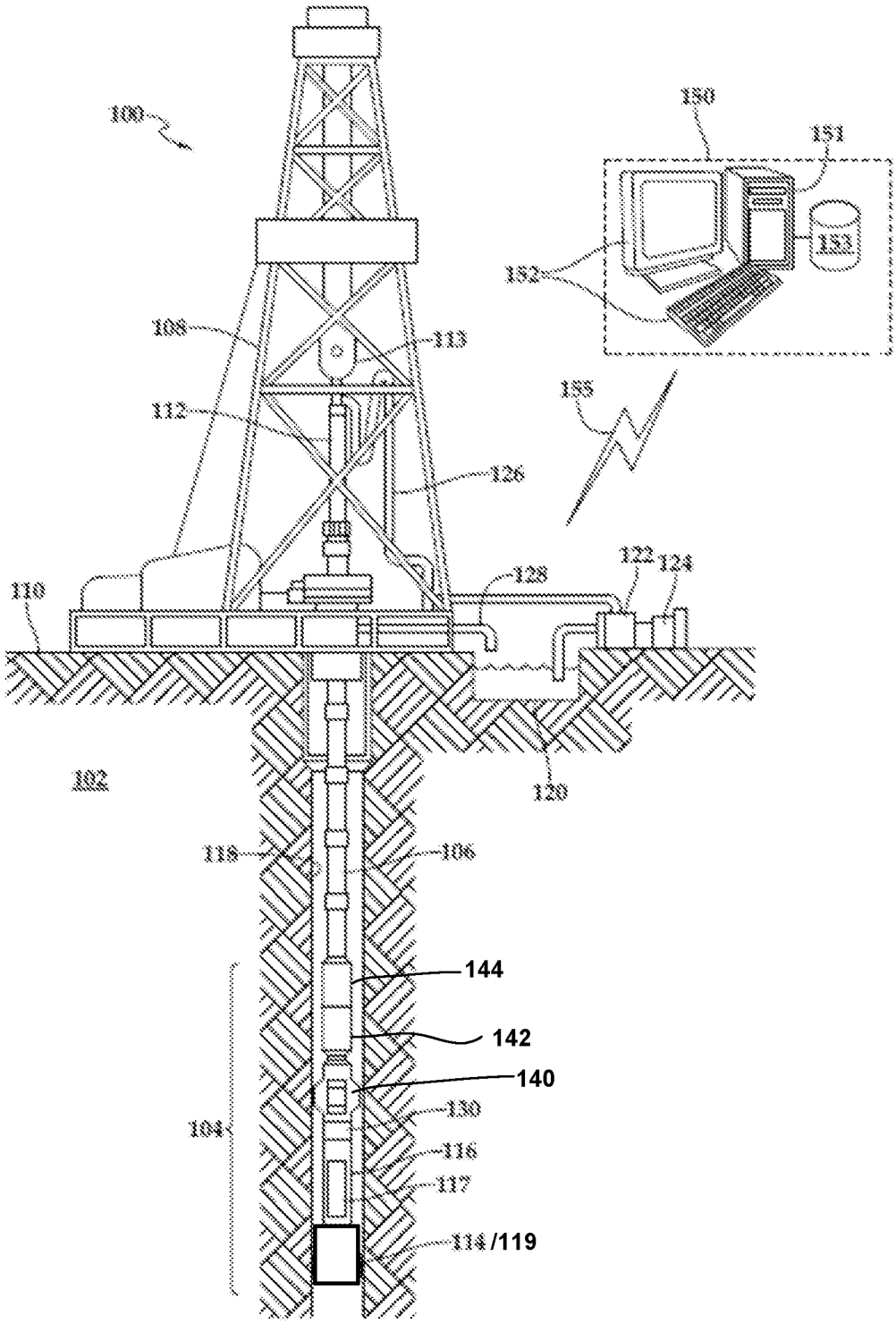
FIG. 1 illustrates a diagram of an embodiment of a well system according to various embodiments.

The drawings are provided for the purpose of illustrating example embodiments. The scope of the claims and of the disclosure are not necessarily limited to the systems, apparatus, methods, or techniques, or any arrangements thereof, as illustrated in these figures. In the drawings and description that follow, like parts are typically marked throughout the specification and drawings with the same or coordinated reference numerals. The drawing figures are not necessarily to scale. Certain features of the invention may be shown to be exaggerated in scale or in somewhat schematic form, and some details of conventional elements may not be shown in the interest of clarity and conciseness.

DETAILED DESCRIPTION

In the following detailed description of the illustrative embodiments, reference is made to the accompanying drawings that form a part hereof. The description that follows includes example systems, methods, techniques, and program flows that embody embodiments of the disclosure. These embodiments are described in sufficient detail to enable those skilled in the art to practice the techniques and methods described herein, and it is understood that other embodiments may be utilized, and that logical structural, mechanical, electrical, and chemical changes may be made without departing from the scope of the disclosure. To avoid detail not necessary to enable those skilled in the art to practice the embodiments described herein, the description may omit certain information known to those skilled in the art. The following detailed description is, therefore, not to be taken in a limiting sense.

The embodiments described herein relate to systems, apparatus, methods, and techniques that utilize one or more cycloid drives to perform one or more wellbore operations in a wellbore. Downhole powered mechanical tools typically include a rotary actuator, such as an electric motor, to provide mechanical power through a series of spur geartrains within a gearbox for torque multiplication at the desired output levels at the downhole tool. The output drive can be in the form of a rotary cutter/miller, reciprocating linear actuator, or driven wheel(s) for the purpose of conveyance of tools and/or conduits along a wellbore.

In existing devices and in the effort to provide miniaturization of and component sizes while maintaining relatively high mechanical power output, the downstream transmission components will experience high stress due to multiplied, high torque transmission through a smaller sized gear tooth. Therefore, in order to design within a reasonable level of safety factor and operational reliability, the permissible output torque in existing devices is reduced accordingly. As a result, the tool's performance is typically limited by the weakest link of the drive train rather than motor's rated capacity.

Embodiments of systems, apparatus, and methods as described herein include replacement of the heavily stressed, downstream drive components with one or more cycloidal drives. The Cycloidal drive is selected because it is a single stage high gear ratio component which has high torque capacity, high efficiency and a compact design. With a cycloidal drive, the output torque can be increased at the output of the cycloid drive, while any other drive components upstream will experience a much lower torque load, which in turn mitigates the risk of a fatigue failure and hence, may provide a longer service life for the tool.

With the use of a drive train utilizing one or more cycloid drives, the downhole tool's performance in terms of mechanical power output can be increased. For example, the actuator and conveyance tools as described below can have a higher payload while the rotary tool can provide a higher cutting force. The compact size of the cycloid drive can also reduce overall tool length. Additionally, the service life of the drive components will be increased significantly resulting in a lower Total Cost of Ownership (TCO).

Embodiments of a cycloidal drive as described herein consists of a housing with ring pins enveloping two epicyclical profile discs (cycloid disc) operating in some embodiments at a 180 deg phase difference for vibration compensation. An output disc is connected to both cycloidal discs and rotor housing via an eccentric shaft (input). In some instances, a relative size comparison between cycloid and other reducers achieves a 75:1 ratio reduction in size of the drive unit with the same power capacity. Due to the nature of the stacked components, cycloid drives are extremely compact and space efficient, resulting in high performance density compared to other transmission mechanisms. Gear ratios can also easily be modified without affecting the outer drive dimensions. Example gear ratios using a cycloid drive include a 15:1 reducer. A higher reduction ratio of up to 35:1 is achievable within the same design envelope by simply increasing the number of ring pins and cycloid disc lobes included in the drive. Larger diameter cycloid drives can also achieve up to 110:1 ratio within a single stage.

In operation of a cycloid drive, multiple cycloidal teeth will mesh with their respective pins, unlike the single tooth pair of involute teeth of the conventional spur gear train. In a cycloidal drive, the contact ratio is typically much higher compared to spur gears. The high contact ratio is advantageous because it allows for multiple pins to be in contact with the gear teeth simultaneously, distributing the load and enhancing load-carrying capacity. The increased contact ratio also contributes to smooth and quiet operation.

In various embodiments as described herein, a cycloidal drive is directly integrated into a component of the tool for greater space efficiency. In various embodiments as described herein, the cycloid drive is built directly into the drive wheel of the conveyance tool, with the wheel itself being the rotor to house the radial pins. This example also illustrates the alternative mode of operation with the rolling pins being stationary and embedded into the arm structure, eccentric pin as the input, and rotor (wheel) as the output. Most of the high transmission forces are experienced by the pins and cycloid discs including in the cycloid drive unit, and not the gear train driving the cycloid drive itself. Therefore, the input of the eccentric shaft of the cycloid drive will experience a much lower torque after reduction, and this allows for greater transmission design flexibility such as using thinner spur gears, chains, or belts to improve efficiency.

FIG. 1 illustrates a diagram of an embodiment of a well system 100 in accordance with various embodiments. Well system 100 is configured to utilize a downhole tool that includes one or a plurality of cycloid drives as described herein, or an equivalent thereof. In various embodiments, a cycloid drive is mechanically coupled to a drill bit 114, the combination of the cycloid drive and the drill bit configured to perform drilling operations on the wellbore 118 of well system 100. In various embodiments, in addition to or instead of a drill bit, a cycloid drive is mechanically coupled to a reciprocating downhole tool, wherein the combination of the cycloid drive and the reciprocating downhole tool are configured to perform one or more operations to be performed downhole within the wellbore. In various embodiments, one or more conveyance tools are positioned and utilized within the wellbore 118, wherein each of the conveyance tool(s) includes a pair of cycloid drives coupled to respective conveyance arms that are positioned along a conduit, a drill string, or other elongated apparatus such as test, fracturing or other tools and that need to be pulled into and positioned along the longitudinal axis of the wellbore.

Embodiments of well system 100 may be configured to move and position a bottom hole assembly (BHA) 104, which may be coupled to a conduit 106 of some type, such as a drill string, which extends from the surface 110 of the well system into the wellbore 118. The conduit 106 may extend from a derrick 108 arranged at the surface 110. Derrick 108 may include a kelly 112 and a traveling block 113 used to lower and raise kelly 112 and conduit 106. Although shown as a vertical wellbore, embodiments of a wellbore included in well system 100 may include portions of a wellbore that extend vertically, horizontally, and/or at some non-vertical and non-horizontal angle relative to surface 110, or any combination thereof. Also, although depicted as a terrestrial based system, embodiments of well system 100 may include systems positioned over a body of water such as a river, lake, sea, or ocean.

In various embodiments, well system 100 may include one or more conveyance tools, such conveyance tool 140, that is coupled to BHA 104 and/or conduit 106, and is configured to be actuated to extend in some embodiments a pair of conveyance arms having a set of drive wheels that are driven by a pair of corresponding cycloid drives. The conveyance arms are configured to allow the drive wheels to contact a wall of a wellbore or an inner surface of a casing extending into the wellbore, and when driven by the cycloid drivers, to exert a pulling force on the BHA and/or the conduit 106 in order to move the BHA and/or the conduit in a longitudinal direction through the wellbore.

In various embodiments, BHA 104 may include drill bit 114 operatively coupled to a BHA 104 that may be moved axially within a drilled wellbore 118 as attached to the conduit 106. The drill bit 114 may be coupled to a BHA 104 that includes a cycloid drive 117 coupled to the drill bit and configured with an output that is mechanically coupled to the drill bit. An actuator device 130, such as an electrical motor, is coupled to the cycloid drive, and is configured to drive the input of the cycloid drive. When driven by the actuator device 130, the cycloid device 1 is 117 configured to rotate the drill bit 114 in order for the drill bit to perform one or more drilling operations. In various embodiments, the cycloid drive rotates the drill bit at a rotational speed that is less than the rotational speed of the motor as applied to the input of the cycloid drive, while generating a rotational torque level at the drill bit that is higher than the rotational torque level provide to the cycloid drive from the motor.

During a drilling operation, drill bit 114 penetrates the earth 102 and thereby creates and extends wellbore 118. As part of a drilling operation, drilling fluid from a drilling fluid tank 120 may contain a quantity of drilling fluid that is pumped downhole using a pump 122 powered by an adjacent power source, such as a prime mover or motor 124, located above surface 110. The drilling fluid may be pumped from the tank 120, through a standpipe 126, which feeds the drilling fluid into conduit 106, which conveys the drilling fluid to drill bit 114. The drilling fluid exits one or more nozzles arranged in drill bit 114, and in the process cools the drill bit. After exiting drill bit 114, the drilling fluid circulates back to the surface 110 via the annulus defined between wellbore 118 and conduit 106, and in the process, returns drill cuttings and debris to the surface. The returning cuttings and mud mixture are passed through a flow line 128 and are processed such that a cleaned drilling fluid is returned to tank 120 and is available to be recirculated downhole through standpipe 126.

In various alternative embodiments, instead of drill bit 114, or in addition to drill bit 114, BHA 104 includes a reciprocating device 119 coupled to and driven by the cycloid drive 117. In various embodiments that include a reciprocating device 119, actuator device 130 drives the cycloid drive 117, which in turn drives an apparatus of the reciprocating device, such as a ball screw, which in turn operates a reciprocating tool, such as a stroker, which may be used to perform wellbore operations such as shifting fluid control valves.

BHA 104 may further include one or more sensors 142. Sensors 142 may be configured to sense one or more physical parameters associated with the wellbore and/or the operation of the BHA 104, such as the rotational speed and direction of actuator and/or of the output tool being driven by the cycloid drive 117. Additional parameters that may be sensed by sensors 142 can include temperature of the actuator device 130, levels of torque being produced by the actuator device 130 and/or by the output of the cycloid drive 117, and levels of vibration occurring at the BHA 104 and/or within conduit 106. The sensors 142 are configured to produce and output signal, such as an electrical or optical output signal, which may be received at a device such as a downhole computing system, and processed in order to determine one or more control instructions for further operations being performed on the well system. For example, sensor output signals provided by one or more of sensors 142 may be processed and used by a computing system to determine one or more operating parameters to be used for the operation of the actuator device 130, such as operating parameters for controlling an electric motor driving the cycloid drive 117.

In various embodiments the BHA 104 included a controller 144 that includes one or more processors and computer memory configured to execute instructions for controlling the operations of the BHA, including the cycloid drive 117. While not specifically shown in FIG. 1, the controller may comprise some combination of or all of the components of the computing system 900 as illustrated and described below with respect to FIG. 9.

Referring back to FIG. 1, in various embodiments the BHA 104 is configured to communicate with one or more other computer devices, such as user interface 150, which may be located above surface 110, and proximate the site of the wellbore 118, or remotely located from the site of the wellbore. User interface 150 may include a computing device 151, such as a personal computer, a lap-top computer, or some other type of user interface device, such as a smart phone. In various embodiments, user interface 150 includes one or more input/output devices 152, for example a display device such as a computer monitor, which is configured to provide visual display of data and other information related to well system 100 and/or to a fluid treatment process being performed on or modeled for wellbore 118. In various embodiments, the display device is configured to display information regarding data received at user interface 150 from the BHA 104 related to the status and/or other parameters associated with the operation of the BHA or other devices included in well system 100. The computer system of user interface 150 may include one or more additional input devices, such as a computer keyboard, computer mouse, and/or a touch screen that allows a user, such as a technician or engineer, to provide inputs to user interface 150, which may include requests for information regarding the status of well system 100 and/or inputs that may be used to direct the operations of the well system 100.

In various embodiments, communications between user interface 150 and BHA 104 may include instructions and/or data configured for the operation of the actuator device 130 controlling the operation of the drill bit 114 and/or the reciprocating device 119. Instructions and data provided by user interface 150 may further include instructions and/or data configured for the operation conveyance tool 140. Communications between the BHA 104 and the user interface 150 may include transmission of data, in some embodiments in real time, resulting from the testing and/or measurements performed by the BHA 104 and which may be derived from one or more of sensors 142. Connections between user interface 150 and other devices included in in well system 100 may be provided by wired and/or wireless communication connection(s), as illustratively represented by lightning bolt 155.

User interface 150 is communicatively coupled to a non-volatile computer readable memory device 153. Memory device 153 is not limited to any particular type of memory device. Memory device 153 may store instructions, such as one or more applications, that when operated on by the processor(s) of the computing device 151, are configured to control the operations of one or more of the devices included in well system 100. Any combination of one or more machine readable medium(s) may be utilized. The machine readable medium may be a machine readable signal medium or a machine readable storage medium. A machine readable storage medium may be, for example, but not limited to, a system, apparatus, or device, which employs any one of or combination of electronic, magnetic, optical, electromagnetic, infrared, or semiconductor technology to store program code. More specific examples (a non-exhaustive list) of the machine readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine readable storage medium may be any tangible medium that can contain, or store a program for use by or in connection with an instruction execution system, apparatus, or device. A machine-readable storage medium is not a machine-readable signal medium.

A machine-readable signal medium may include a propagated data signal with machine readable program code embodied therein, for example, in baseband or as part of a carrier wave. Such a propagated signal may take any of a variety of forms, including, but not limited to, electromagnetic, optical, or any suitable combination thereof. A machine-readable signal medium may be any machine-readable medium that is not a machine readable storage medium and that can communicate, propagate, or transport a program for use by or in connection with an instruction execution system, apparatus, or device.

Program code embodied on a machine readable medium may be transmitted using any appropriate medium, including but not limited to wireless, wireline, optical fiber cable, RF, etc., or any suitable combination of the foregoing. Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine. The program code/instructions may also be stored in a machine readable medium that can direct a machine to function in a particular manner, such that the instructions stored in the machine readable medium produce an article of manufacture including instructions which implement the function/act specified in the flowchart and/or block diagram block or blocks.

Figure 2:
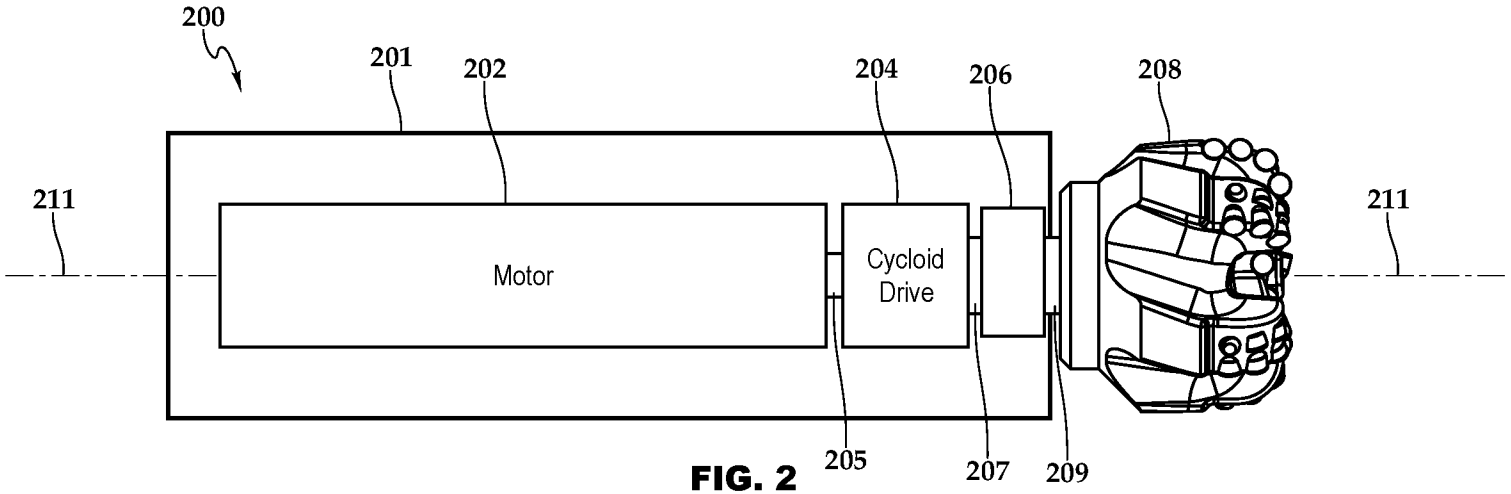
FIG. 2 illustrates a functional block diagram of a downhole tool including a transmission drive unit in accordance with various embodiments.

FIG. 2 illustrates a functional block diagram of a downhole tool 200 including a transmission drive unit in accordance with various embodiments. In various embodiments, downhole tool 200 may be incorporated into a bottom hole assembly, such as BHA 104 as illustrated and described above with respect to FIG. 1, and may be configured to provide some combination of the features and to perform any of the functions ascribed with BHA 104 in association with system 100 of FIG. 1.

As shown in FIG. 2, downhole tool 200 includes a motor 202, a cycloid drive 204, and a coupling 206 positioned within a tool body 201 of the downhole tool. Motor 202, cycloid drive 204, and coupling 206 are aligned with one another along a longitudinal axis 211 extending through the center of tool body 201. An output shaft 205 extending from motor 202 is mechanically coupled to an input of cycloid drive 204. An output shaft 207 is mechanically coupled to the output of the cycloid drive 204, and is mechanically coupled to coupling 206. Coupling 206 is also mechanically coupled to shank 209 of drill bit 208, which also aligned with the longitudinal axis 211 extending through the center of the tool body 201.

Motor 202 in various embodiments is an electrically powered motor configured to receive electrical power from an electrical source (not shown in FIG. 2), such as an electrical generator located on the surface where downhole tool 200 may be positioned within a wellbore, or by an electrical turbine included as part of a bottom hole assembly (e.g., bottom hole assembly 104, FIG. 1), coupled to downhole tool 200. In other embodiments, motor 202 may be a hydraulically or pneumatically powered device. In various embodiments, the operating parameters associated with motor 202, such as the rotational speed of output shaft 205, and/or other operating parameters of motor 202, may be controlled by a control system, such as computer system located at the surface (e.g., user interface 150, FIG. 1), or a control system located within a bottom hole assembly that includes downhole tool 200, (such as a computer system 900, FIG. 9).

The operation of the motor 202 results in the rotation of shaft 205 at a regulated rate of rotation, and providing a controllable amount of torque. Examples include operation of the motor at a rotational speed in a range from 1,500 to 10,000 revolutions-per-minute (RPM) inclusive, and producing a level of rotational torque at the output of motor 202 in a range from 0.4 to 2.2 pound-feet (0.542 to 2.983 Newton-meters), inclusive. The rotational motion of shaft 205 is applied to the input of cycloid drive 204. Due to the mechanical construction of the cycloid drive 204, in various embodiments the output shaft 207 extending from the cycloid drive 204 is rotated at a rotational speed that is less than the rotational speed of shaft 205, while shaft 207 is providing an increased level of torque to the coupling 206 as compared to the level of torque being provided to the input of the cycloid drive by motor 202 and shaft 205. In various embodiments, the rotating speed of the shaft 207, and thus coupling 206, is in a range from 50 to 500 RPM, inclusive, while providing a torque in a range from 100 to 650 pound-feet (136 to 881 Newton-meters), inclusive.

The reduced rate of rotation and the higher torque levels that are provided to shaft 207 from cycloid drive 204 are transferred through coupling 206 to shank 209, and thus to drill bit 208, to be applied to a drilling operation being performed by the drill bit for example in advancing a wellbore. The use of the cycloid drive 204 allows motor 202 to operate at higher rotational speeds, and thus produce more power than would be provided at lower motor operating speeds, while allowing a slower rotational speed and a higher torque level to be provided to the drill bit. In various embodiments, one or more sensed parameters, such as drill speed, weight on bit, motor temperature, vibration within the downhole tool 200, and other physical parameter may be sensed by various sensors, such as sensors 142, FIG. 1, which may include one or a combination of resolvers, load cells, resistance temperature detectors, and/or accelerometers, and which may be used to control the operation of motor 202, and thus the operational parameters such as drill speed and applied torque that are associated with the operation of the drill bit 208.

Figure 3:
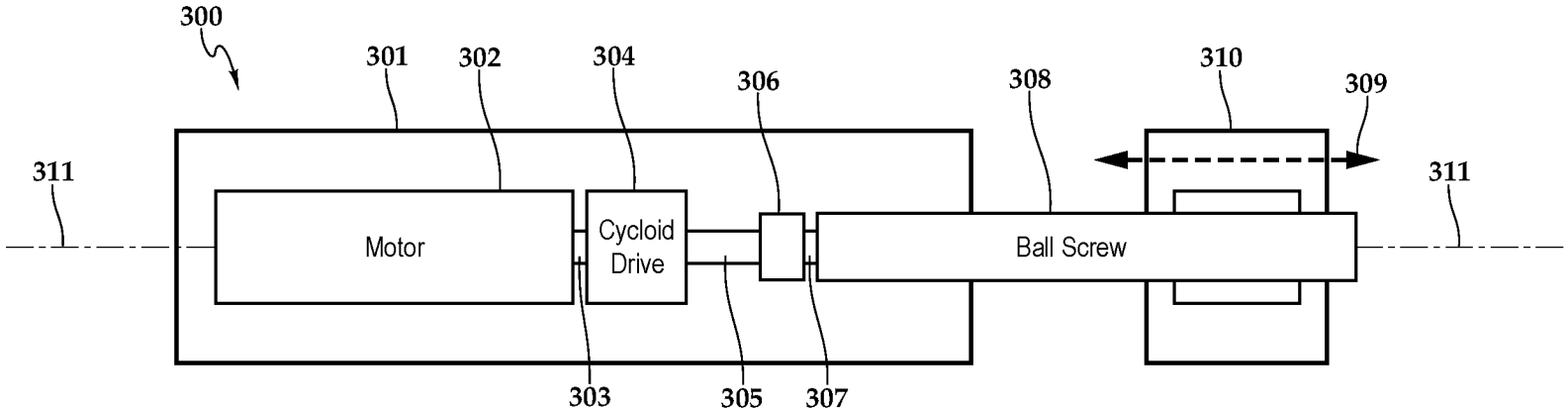
FIG. 3 illustrates a functional block diagram of a downhole tool including a transmission drive unit in accordance with various embodiments.

FIG. 3 illustrates a functional block diagram of a downhole tool 300 including a transmission drive unit in accordance with various embodiments. In various embodiments, downhole tool 300 may be incorporated into a bottom hole assembly, such as BHA 104 as illustrated and described above with respect to FIG. 1, and may be configured to provide some combination of the features and to perform one or more of the functions ascribed with BHA 104 in association with system 100 of FIG. 1.

As shown in FIG. 3, downhole tool 300 includes a motor 302, a cycloid drive 304, and a coupling 306 positioned within a tool body 301 of the downhole tool. In various embodiments, a ball screw 308 may extend at least partially into the tool body 301. As shown in FIG. 3, motor 302, cycloid drive 304, coupling 306, and ball screw 308 align with one another along a longitudinal axis 311 extending through the center of tool body 301. An output shaft 303 extending from motor 302 is mechanically coupled to an input of cycloid drive 304. An output shaft 305 extending from the output of cycloid drive 304 is mechanically coupled to coupling 306. Coupling 306 is also mechanically coupled to ball screw 308 through shaft 307. In various embodiments, ball screw 308 is mechanically linked to or includes a reciprocating tool 310 that is configured to move back and forth in a direction parallel to longitudinal axis 311, (for example as indicted by arrow 309), when ball screw 308 is operating.

Motor 302 may include and/or be configured to operate in any of the configurations and/or in any manner as described above with respect to motor 202 and FIG. 2. For example, motor 302 as included in the downhole tool 300 of FIG. 3 in various embodiments is an electrically powered motor configured to receive electrical power from an electrical source (not shown in FIG. 3), such as an electrical generator located on the surface where downhole tool 300 may be positioned within a wellbore, or by an electrical turbine included as part of a bottom hole assembly (e.g., bottom hole assembly 104, FIG. 1), coupled to downhole tool 300. In other embodiments, motor 302 may be a hydraulically or pneumatically powered device. In various embodiments, the operating parameters associated with motor 302, such as the rotational speed of the motor 302 and/or other operating parameters of motor 302 may be controlled by a control system, such as computer system located at the surface (e.g., user interface 150, FIG. 1), or located within a bottom hole assembly that includes downhole tool 300, (such as computer system 900, FIG. 9).

The operation of the motor 302 results in the rotation of shaft 303 at a regulated rate of rotation, and providing a controllable amount of torque. The rotational motion of shaft 303 is applied to the input of cycloid drive 304. Due to the mechanical construction of the cycloid drive 304, in various embodiments the output shaft 305 extending from the cycloid drive 304 is rotated at a rotational speed that is less than the rotational speed of shaft 303, while shaft 305 is providing an increased level of torque to the coupling 306 as compared to the level of torque being provided to the input of the cycloid drive by motor 302 and shaft 303.

The reduced rpm and higher torque levels provided by cycloid drive 304 at shaft 305 are transferred through coupling 306 to shaft 307 and ball screw 308. Ball screw 308 is configured to drive the reciprocating tool 310 back and forth in a direction parallel to longitudinal axis 311, indicted by the double-headed arrow 309 in FIG. 3. In various embodiments, the reciprocating tool 310 is used to perform various wellbore operations, such as but not limited to shifting of fluid control valves. The use of the cycloid drive 304 allows motor 302 to operate at higher rotational speeds, and thus produce more torque than would be provided at lower motor operational speeds, while allowing a slower reciprocating speed, and a higher level of linear force to be provided to the reciprocating tool 310. In various embodiments, various sensed parameters, such as rotational speed of motor 302, reciprocating speed of tool 310, motor temperature, vibration within the downhole tool 300, and other physical parameter may be sensed by various sensors 142 (FIG. 1), which may include one or a combination of resolvers, load cells, resistance temperature detectors, and/or accelerometers, and which may be used to control the operation of motor 302, and thus the operational parameters that are associated with the operation of the ball screw 308 and reciprocating tool 310.

Figure 4:
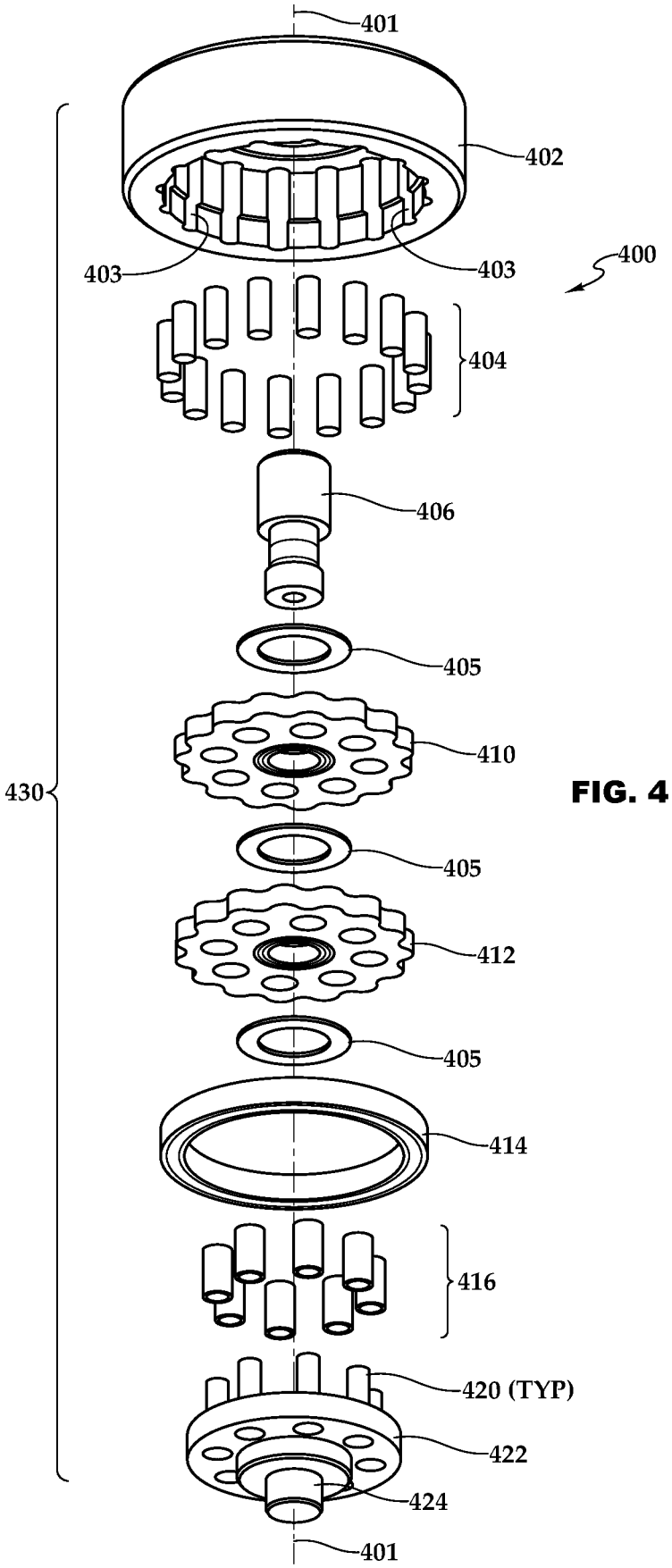
FIG. 4 illustrates an exploded view of a cycloidal drive according to various embodiments.

FIG. 4 illustrates an exploded view of a cycloidal drive 400 according to various embodiments. Embodiments of cycloid drive 400 may be utilized in a bottom hole assembly, such as BHA 104 as illustrated and described above with respect to FIG. 1. Embodiments of cycloid drive 400 may be utilized in the downhole tool 200 as illustrated and described above with respect to FIG. 2 and/or may be utilized in downhole tool 300 as illustrated and described above with respect to FIG. 3.

In FIG. 4, the individual components of cycloid drive 400 are expanded in the figure along a longitudinal axis 401 that extends through the centerline of the cycloid drive. Moving in a directions from bottom to top in FIG. 4, cycloid drive 400 includes an output shaft coupled to an output hub 422 that includes a ring of individual pins 420 arranged in a circular pattern on left-hand facing side of hub 422. Each of the pins 420 are configured to receive a respective one of the rolling sleeves 416. Rolling sleeves 416 are configured to extend into the inner circle of openings arranged in a circular pattern and extending through both the first cycloid disc 412 and the second cycloid disc 410. Spacers 405 are positioned on either side and between the first and second cycloid discs. Eccentric shaft 406 is configured to extend through a center opening in both the first cycloid disc 412 and the second cycloid disc 410, and having an end that is configured to be mechanically coupled to the rotor housing 402. The first cycloid disc 412 includes a first set of teeth that extend around the outer perimeter of the first cycloid disc. The second cycloid disc 410 includes a second set of teeth that extend around the outer perimeter of the second cycloid disc. When assembled on the eccentric shaft 406, the first cycloid disc 412 and the second cycloid disc 410 are positioned on and coupled to the eccentric shaft in different fixed positions relative to each other such that the teeth of the first cycloid disc are offset by an angular degree from each of the adjacent teeth of the second cycloid disc. A set of ring pins 404 is configured to engage the teeth of each of the first cycloid disc 412 and the second cycloid disc 410 on the inner portions of the ring pins, and to engage a corresponding set of slots 403 formed on an inside surface of housing 402 along an outer portion of the ring pins.

When assembled, the eccentric shaft 406 is configured as the drive input for the cycloid drive 400. For conventional mode of operation, rotor housing 402 is stationary, and output disc 422 rotates with a slower rate of rotation and higher level of torque compared to the rotational rate and torque level of eccentric shaft 406. The eccentric shaft 406 will rotate both cycloid discs 410 and 412, which in turn engage with the stationary ring pins 404. Both cycloid discs also simultaneously engages with the rolling pins 416 to rotate the output disc 422. Rotation of output disc 422 also drives rotation of output shaft 424.

For the "reverse" or "non-conventional" mode of operation, the output disc 422 is stationary and the rotor housing 402 acts as the drive output. The eccentric shaft 406 is still the input that rotates along axis 401, which is mechanically coupled to both cycloid discs 410 and 412, causing them to engage with rolling pins 416 that is assembled to the stationary disc 422. The engagement causes the both cycloid discs to wobble about axis 401, causing the ring pins 404 and housing 402 to rotate about axis 401 at a slower rate and providing a higher torque compared to the rotational rate and torque level provided at eccentric shaft 406.

In various embodiments, housing 402 may be positioned adjacent to and rotate on a housing seal that allows the housing 402 to rotate relative to a fixed position chassis or other tool body structure designed to position the cycloid drive 400 within a downhole tool.

Embodiments of cycloid drive 400 may be designed to provide different levels of rotational rate transformations and different levels of changes in rotational torque levels present at the housing 402 compared to these same physical parameters applied to the hub 422 based on the design of the devices included within the cycloid disc, including the diameter of the cycloidal discs, the arrangement and number of teeth included in the perimeters of the cycloidal discs.

Figure 5A:
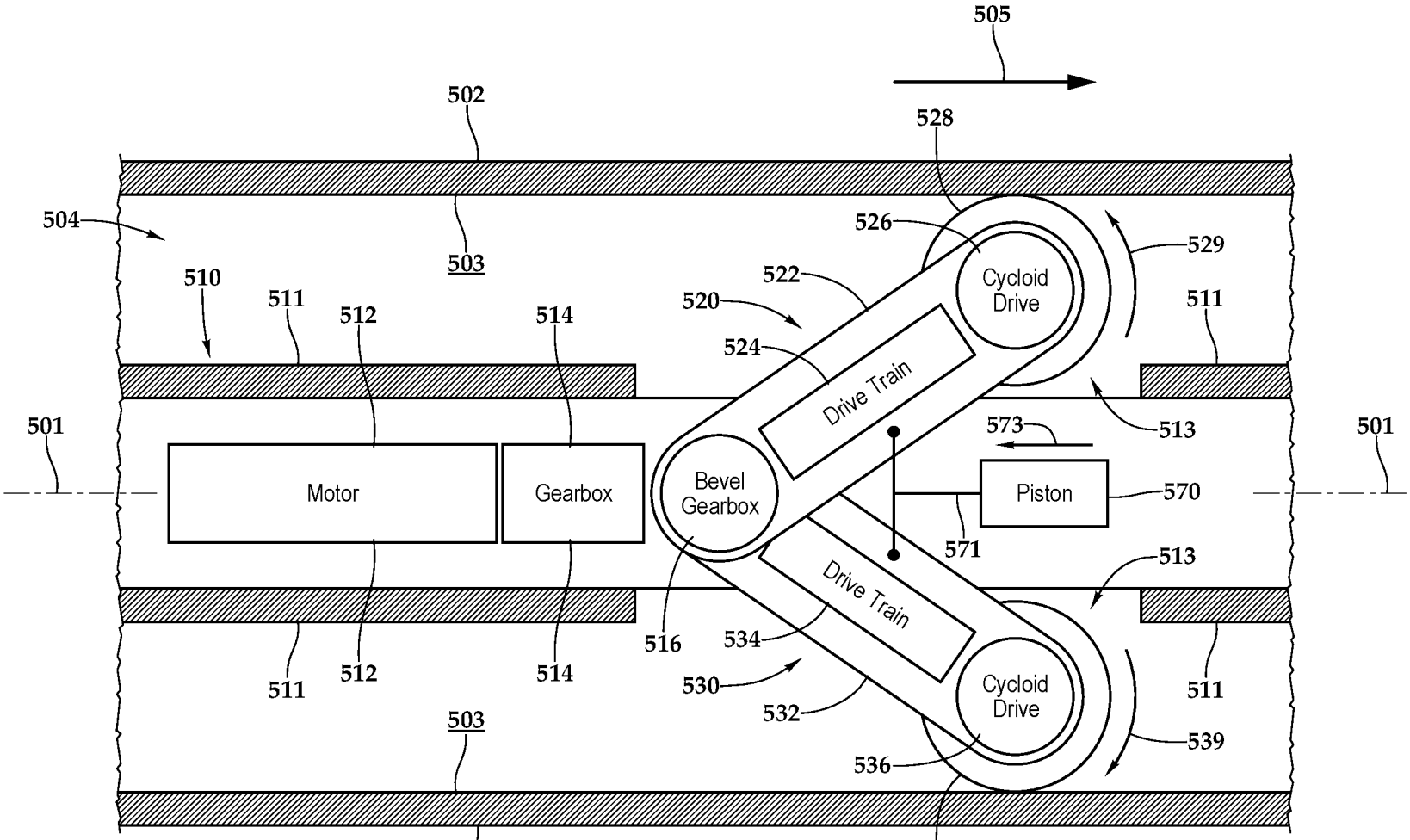
FIG. 5A illustrates a functional block diagram of a downhole conveyance tool according to various embodiments.

FIG. 5A illustrates a functional block diagram of a downhole conveyance tool (conveyance tool) 510 according to various embodiments. In various embodiments, conveyance tool 510 may be included in a wellbore system, such as well system 100 as illustrated and described above with respect to FIG. 1, and may be used to aid in the movement and/or positioning of a drill string, a downhole tool, and/or other conduit or piping apparatus being placed within a wellbore.

As shown in FIG. 5A, conveyance tool 510 includes a pair of conveyance arms 520, 530, coupled to a tool body 511 of the conveyance tool at beveled gearbox 516. Beveled gearbox 516 is configured to allow conveyance arms 520 and 530 to be positioned in a first configuration within openings 513 of tool body 511, for example in a stacked arrangement (e.g., see side view of conveyance tool 510, FIG. 5C), and having the longitudinal axis of each of the conveyance arms aligned with the longitudinal axis 501 of the conveyance tool 510. Beveled gearbox 516 is further configured to allow conveyance arms 520 and 530 to move to a second configuration as shown in FIG. 5A, wherein an end portion of each of the conveyance arms 520 and 530 that is located farthest from the beveled gearbox 516 are extended outward at an angle from the tool body 511. As shown in FIG. 5A, each of the end portions of conveyance arms 520 and 530 includes a respective drive wheel 528, 538, which are configured to contact a portion of a wellbore 504, such as an inner surface 503 of a casing 502 extending along the wellbore adjacent to the location within the wellbore where the conveyance tool 510 is located.

When driven by a mechanical force ultimately provided by motor 512 and transferred to the respective drive wheels 528 and 538 as further described below, the conveyance tool 510 may be propelled in a direction through the wellbore, such as the direction indicated by arrow 505. In the embodiment illustrated in FIG. 5A, drive wheel 528 of conveyance arm 520 is configured to be driven by cycloid drive 526, and rotated in a counterclockwise direction as indicated by arrow 529, and drive wheel 538 of conveyance arm 530 is configured to be driven by cycloid drive 536 and rotated in a clockwise direction as indicated by arrow 539. A piston 570 is coupled through a configuration of connecting devices 571, such as connecting rods, to each of the conveyance arms 520 and 530. In various embodiments, a set of pins or studs located at the ends of connecting device 571 engage slots (such as slots 551, 552, FIG. 5B), included in some portion of each of the conveyance arms. Actuation of the piston back and forth exerts movement of the connecting device 571, which in turn moves the set of pins or studs within the respective slots of the conveyance arms 520, 530, which in turn caused the conveyance arms to be extended outward or retracted inward depending on the direction of motion of the piston 570.

By way of example, extension of the piston 570 in the direction indicated by arrow 573 causes the connecting device 571 to exert an outward force applied through beveled gearbox 516 to each of the conveyance arms 520 and 530 exerts a force on the chassis 522 of the first conveyance arm 520 urging the first conveyance arm to move outward at an angle from longitudinal axis 501, and exerts a force on chassis 532 of the second conveyance arm 530 urging the second conveyance arm to move outward at an angle away from and on the opposite side of longitudinal axis 501 relative to the direction and angle of the first conveyance arm. The outward movement of the first and second conveyance arms extends the conveyance arms at an angle 553 (see FIG. 5B) relative to one another, and results in a contact force between each of drive wheels 528 and 528 and inner surface 503 of casing 502, while the rotational forces applied to each of the drive wheels from the respective drive trains 524 and 534 included in the respective conveyance arms exerts a force urging the conveyance tool 510, and therefore the tool body 511 of the conveyance tool, to move in a direction within the wellbore 504 in the direction as indicated by arrow 505.

Following along with this same example, retraction of the piston 570 in the direction opposite the direction indicated by arrow 573 results in movement of the connecting device 571, which in turn moves the set of pins or studs within the respective slots of the conveyance arms 520, 530, which in turn caused the conveyance arms to be retracted inward so that drive wheels 528 and 538 are drawn back inward toward the longitudinal axis 501 and eventually are recessed within the tool body 51.

Figure 5B:
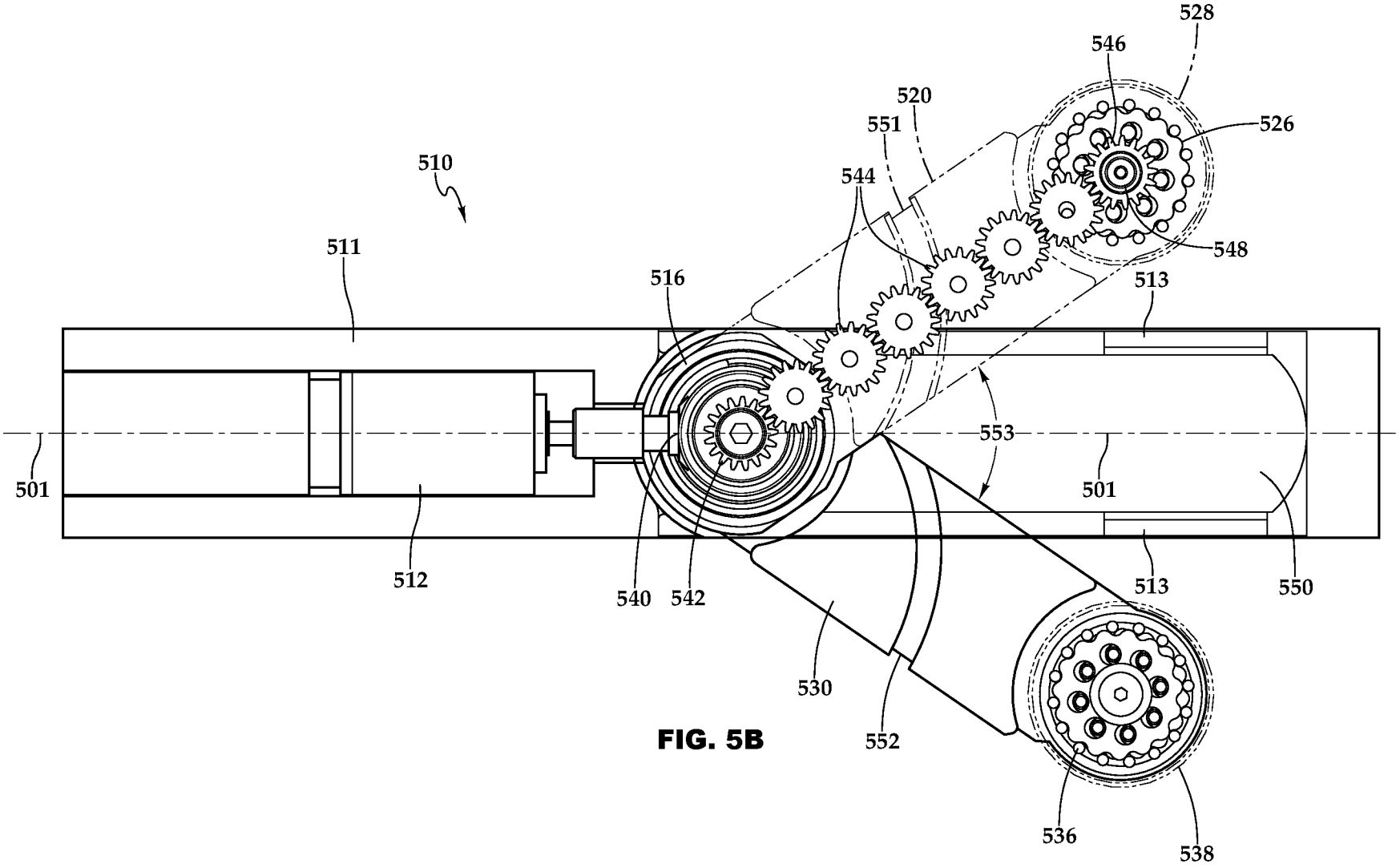
FIG. 5B illustrates a top view of an embodiment of the conveyance tool of FIG. 5A.

FIG. 5B illustrates a top view of an embodiment of the conveyance tool 510 of FIG. 5A. As shown in FIG. 5B, tool body 511 includes motor 512 mechanically coupled to the beveled gearbox 516, and having the first conveyance arm 520 extending away from the beveled gearbox 516 at a first angle relative to the longitudinal axis 501, and the second conveyance arm 530 extend away from the beveled gearbox 516 at a second angle relative to and on the opposite side of the longitudinal axis 501 compared to the first conveyance arm. As shown in FIG. 5B, the first conveyance arm 520 extends away from tool body 511 through an opening 513 in the tool body to position the first cycloid drive 526 and the drive wheel 528 of the first conveyance arm outside of the tool body, while the second conveyance arm 530 extends away from tool body 511 through the opening 513 in the tool body and positions the second cycloid drive 536 and the drive wheel 538 of the second conveyance arm also outside of the tool body. When positioned as shown in FIG. 5B, and when driven by mechanical rotation provided by motor 512, the drive wheels 528 and 538 may be brought into contact with an inner surface of a wellbore or a casing, and exert a pulling force on the inner surface of the wellbore or a casing that allows the conveyance tool to move the conveyance tool and any attached conduit or other downhole tool(s) that are coupled to the conveyance tool in a longitudinal direction along longitudinal axis 501.

An example embodiment of a drive train for the first conveyance arm 520 that mechanically couples the motor 512 to the first cycloid drive 526 is further illustrated in FIG. 5B. As shown in in the figure, a pinion gear 540 that is coupled to and configured to be rotated by the output shaft driven by motor 512 which engages with a bevel gear (not shown in FIG. 5B, but see bevel gear 541, FIG. 5C), that is mechanically linked to first drive gear 542. First drive gear 542 is mechanically linked to a chain of spur gears 544 that extend along the longitudinal axis of the first conveyance arm 520, and are further mechanically linked to the first cycloid drive gear 546. The first cycloid drive gear 546 is mechanically linked to the eccentric shaft 548 of the first cycloid drive 526.

When pinion gear 540 is rotated by the operation of motor 512, the pinion gear rotates the bevel gear coupled to first drive gear 542, which in turn rotates the first drive gear, the chain of spur gears 544, and the first cycloid drive gear 546. Rotation of the first cycloid drive gear 546 in turn rotates eccentric shaft 548, which operates the first cycloid drive 526 to rotate the first drive wheel 528. A corresponding set of gears as arranged and configured to operate as described for the first cycloid drive are included in the second cycloid drive 536, wherein when rotated by the pinion gear 540, the drive train included in the second conveyance arm is configured to operate the second cycloid drive 536 and rotate the second drive wheel 538 in a manner similar to that described above, but having drive wheel 538 rotate in a direction opposite the direction of rotation of drive wheel 528. As shown in FIG. 5B, conveyance arm 520 includes a slot 551 extending across the chassis of the arm, and conveyance arm 530 includes a slot 552 extending across the chassis of the arm. Slots 551 and 552 are configured to engage a respective set of pins or studs, such as shown as part of connecting device 571 (FIG. 5A) to allow the conveyance arms to be extended and retracted as described above.

Figure 5C:
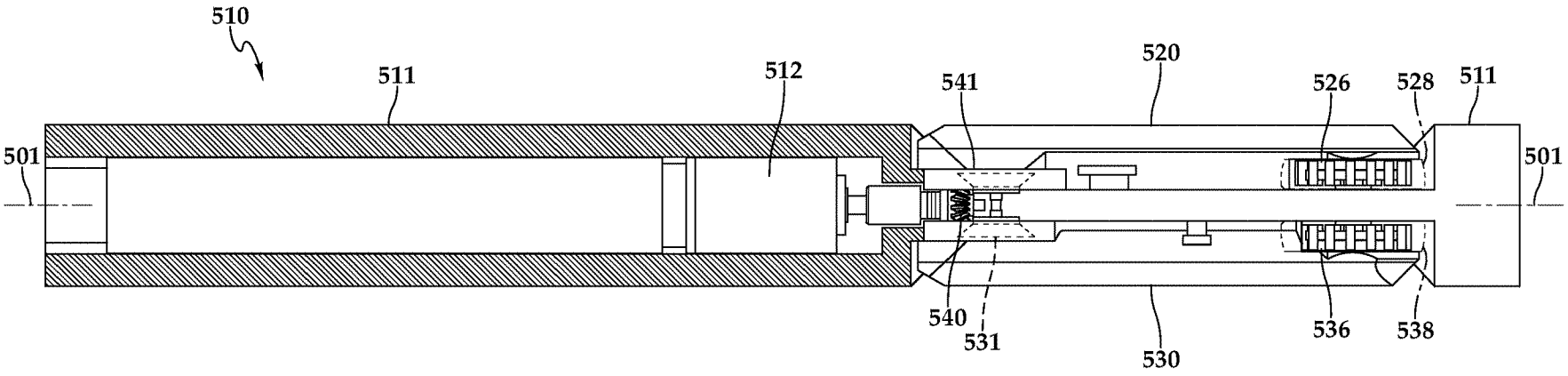
FIG. 5C illustrates a side view of an embodiment of the conveyance tool illustrated and described with respect to FIGS. 5A and 5B.

FIG. 5C illustrates a side view of an embodiment of the conveyance tool 510 illustrated and described with respect to FIGS. 5A and 5B. As shown in FIG. 5C, the first conveyance arm 520 and the second conveyance arm 530 are positioned in a retracted position within the tool body 511 such that the first conveyance arm 520 is "stacked" above and aligned with the second conveyance arm 530, and wherein the longitudinal axis of each of the conveyance arms aligns approximately with the longitudinal axis 501 of the conveyance tool. In various embodiments, this positioning of the first and second conveyance arms would be utilized when preparing to insert the conveyance tool 510 into a wellbore, and/or when the conveyance tool is positioned within a wellbore but it not being used at the time to move or position the downhole tool or tool string coupled to the conveyance tool. In various embodiments, a center section 550 of the tool body 511 separates the first conveyance arm 520 from the second conveyance arm 530, and provides the structure for mounting and securing the beveled gearbox where the ends of each of the conveyance arms are rotationally secured.

As further illustrated in FIG. 5C, the pinion gear 540 that is mechanically coupled to and rotationally driven by motor 512 engages both the bevel gear 541 of the first conveyance arm 520 and the bevel gear 531 of the second conveyance arm 530. Using this arrangement, the use of a single motor (motor 512) and single pinion gear (pinion gear 540) may be used to drive both of the drive trains used to operate both the cycloid drives of the first and second conveyance arms. Further, the arrangement of the pinion and bevel gears as illustrated in FIGS. 5A-5C allow the pinion and bevel gears to rotate relative to one another and thus allow the first and second conveyance arms to move for the retracted position as shown in FIG. 5C to the extended position as shown in FIGS. 5A and 5B while also operating the drive trains and the cycloid drives of each conveyance arm once the conveyance arms reach the extended position and the drive wheels of each of the conveyance arms have made contact with a surface of a wellbore or a casing within the wellbore.

Figure 6A:
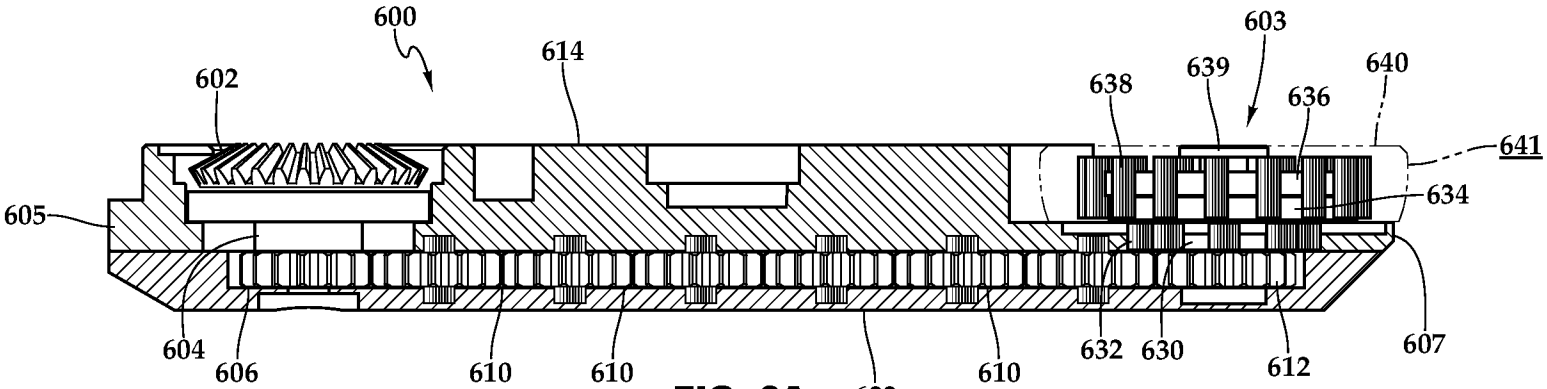
FIG. 6A illustrates a partial cutaway side view of a conveyance arm according to various embodiments.

FIG. 6A illustrates a partial cutaway side view of a conveyance arm 600 according to various embodiments. Embodiments of conveyance arm 600 may be utilized as conveyance arms 520 and 530 as illustrated and described above with respect to FIGS. 5A-5C. As shown in FIG. 6A, conveyance arm 600 includes a beveled gear 602 positioned adjacent a first end 605, (left-hand side of FIG. 6A) of chassis 614, and a cycloid drive 603 positioned adjacent a second end 607, (right-hand side in FIG. 6A) of chassis 614. The beveled gear 602 is mechanically coupled to and held in position with chassis 614 by shaft 604, which extends through the chassis and is mechanically coupled to a first drive gear 606. First drive gear 606 is engaged to drive a series of spur gears 610, which mechanically link the first drive gear to cycloid drive input gear 612. The cycloid drive input gear 612 is mechanically coupled to the eccentric shaft 630 of the cycloid drive 603. In various embodiments, cover 622 extend from first end 605 to the second end 607 and over the bottom side of chassis 614 in order to cover and protect the first drive gear 606, spur gears 610, and cycloid drive input gear 612.

In various embodiments, beveled gear 602 is positioned within a beveled gearbox, such as beveled gearbox 516 (FIG. 5A, 5B), and is configured to be rotated through a coupling to another gear, such as a pinion gear 540 (FIGS. 5A, 5B), which is being powered for example by a motor. When rotated by another gear, beveled gear 602 in turn rotates shaft 604, which in turn rotates first drive gear 606. By virtue of the mechanical linkages between the first drive gear 606 and spur gears 610, the rotational force of first drive gear 606 is transferred to the cycloid drive input gear 612. The rotational force resulting in the rotation of the cycloid drive input gear 612 causes rotation of the eccentric shaft 630 of the cycloid drive 603. Rotation of the eccentric shaft 630 operates the cycloidal drive 603, resulting in the rotation of drive wheel 640 at a rotational speed that is less than the rotational speed of the rotating eccentric shaft 630 while transferring a larger amount of torque to the drive wheel 640 compared to the level of torque present at the cycloidal drive input gear 612.

When configured as illustrated in FIG. 6A, the eccentric shaft 630 engages both the first cycloid disc 634 and the second cycloid disc 636 included in the cycloid drive. Sets of teeth located around the outside perimeters of the first cycloid disc 634 and the second cycloid disc 636, respectively, engage a set of ring pins 638, which are driven in a circular path around the cycloid drive 603, and which also engage with an inner surface of the drive wheel 640, thereby rotating the drive wheel around a center pin 639 when the ring pins are being rotated in the above mentioned circular path. When extended into a position of contact with a wall of a wellbore or with an inner surface of a casing extending into the wellbore, an outer surface 641 of the drive wheel can exert a force on the wall of the wellbore or the casing, thereby exerting a pulling force to be transferred to the chassis 614 of the conveyance arm in order to urge the conveyance arm, and any downhole tools or other conduits coupled to the conveyance arm 600, in a longitudinal direction through the wellbore. Although shown in FIG. 6A as smooth surface, in various embodiments outer surface 641 of the drive wheel 640 may include teeth, ridges, slots, and/or other variations in the surface that enhance the capability of the outer surface to engage and maintain traction with a surface, such as a wall of a wellbore or an inner surface of a casing which has been brought into contact with the outer surface of the drive wheel. In various embodiments, drive wheel 640 may be formed from metal or a metal alloy, such as steel.

Because of the construction of the cycloidal drive 603, the rotational speed of the drive wheel 640 may be provided at a lower rotational speed compared to the rotational speed of the cycloid drive input gear 612, while providing a higher level of torque at the drive wheel compared to the level of torque being provided at the input drive gear. Among other advantages, this arrangement allows the drive train, such as beveled gear 602, first drive gear 606, spur gears 610, and cycloid drive input gear 612 to operate a lower torque level, and thus reduce stress on these components and/or allow smaller more compact pieces to be used in the drive train of the conveyance arm while still providing the required level of torque at the drive wheel 640 in order to achieve a desired level of performance from the conveyance tool that includes conveyance arm 600.

Figure 6B:
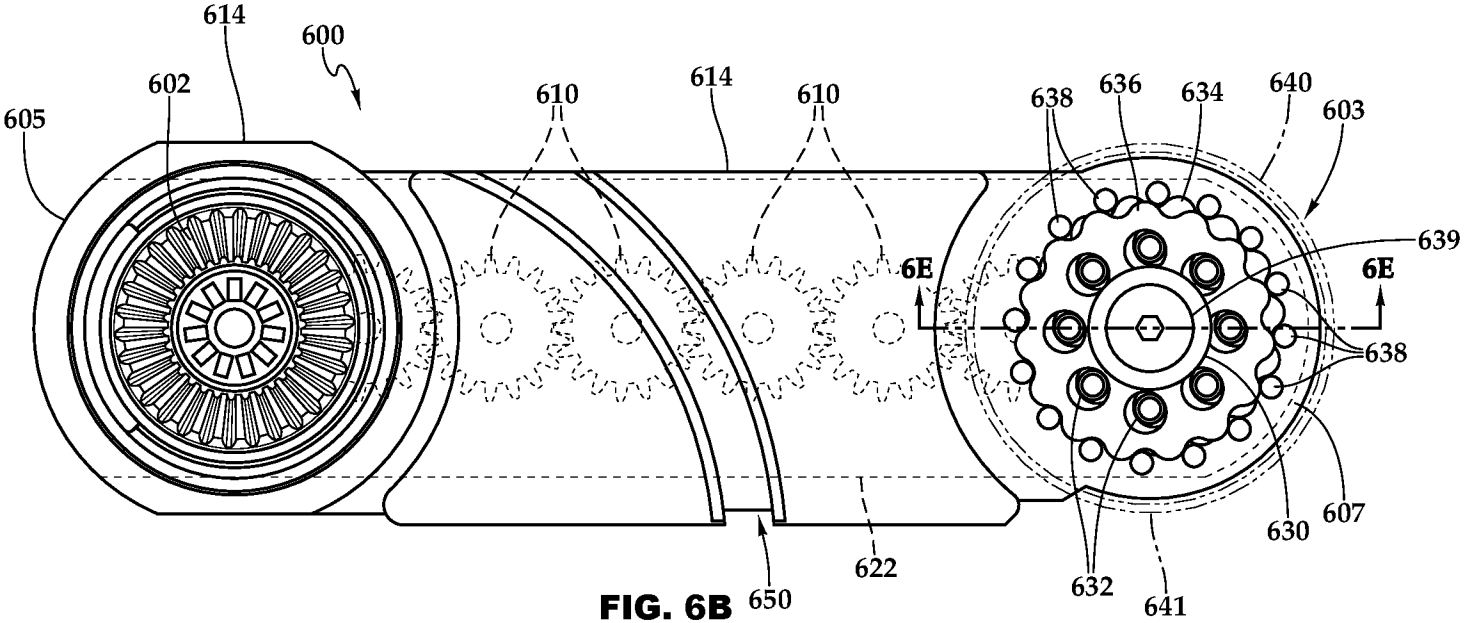
FIG. 6B illustrates a top view of the conveyance arm of FIG. 6A.

FIG. 6B illustrates a top view of the conveyance arm 600 of FIG. 6A. As shown in FIG. 6B, the beveled gear 602 is positioned at the first end 605 of chassis 614, and the cycloid drive 603 is positioned at the second end 607 of the chassis. The series of interconnected spur gears 610 mechanically couple the beveled gear 602 to the cycloid drive 603. The spur gears 610 are shown in FIG. 6B as "hidden" because they are positioned on the bottom side of the chassis 614 relative to the positioning of the beveled gear 602 and the cycloid drive 603. In FIG. 6B, the drive wheel 640 is shown using phantom lines in order to allow a top view of the rolling pins 632, the top surface of the cycloid disc 636, the outer perimeter and the toothed surfaces of the cycloid disc 634, the rings pins 638, and center pin 639 all to be visible in the illustration using solid lines.

As shown in FIG. 6B, chassis 614 includes a curved slot 650 configured to engage a pin or a stud positioned on connection device of a conveyance tool, such as connection device 571 (FIG. 5A), located adjacent to the chassis when the conveyance arm 600 is positioned in a conveyance tool. The combination of the pin or stud and slot 650 are configured to allow the conveyance arm 600 or extend from the retracted position within the conveyance tool to the extended position, allowing the outer surface 641 of the drive wheel 640 to engage an inner surface of a casing or a wall of a wellbore, while providing added strength and stabilization to the positioning of the conveyance arm while the conveyance arm is extended out from the tool body.

Figure 6C:
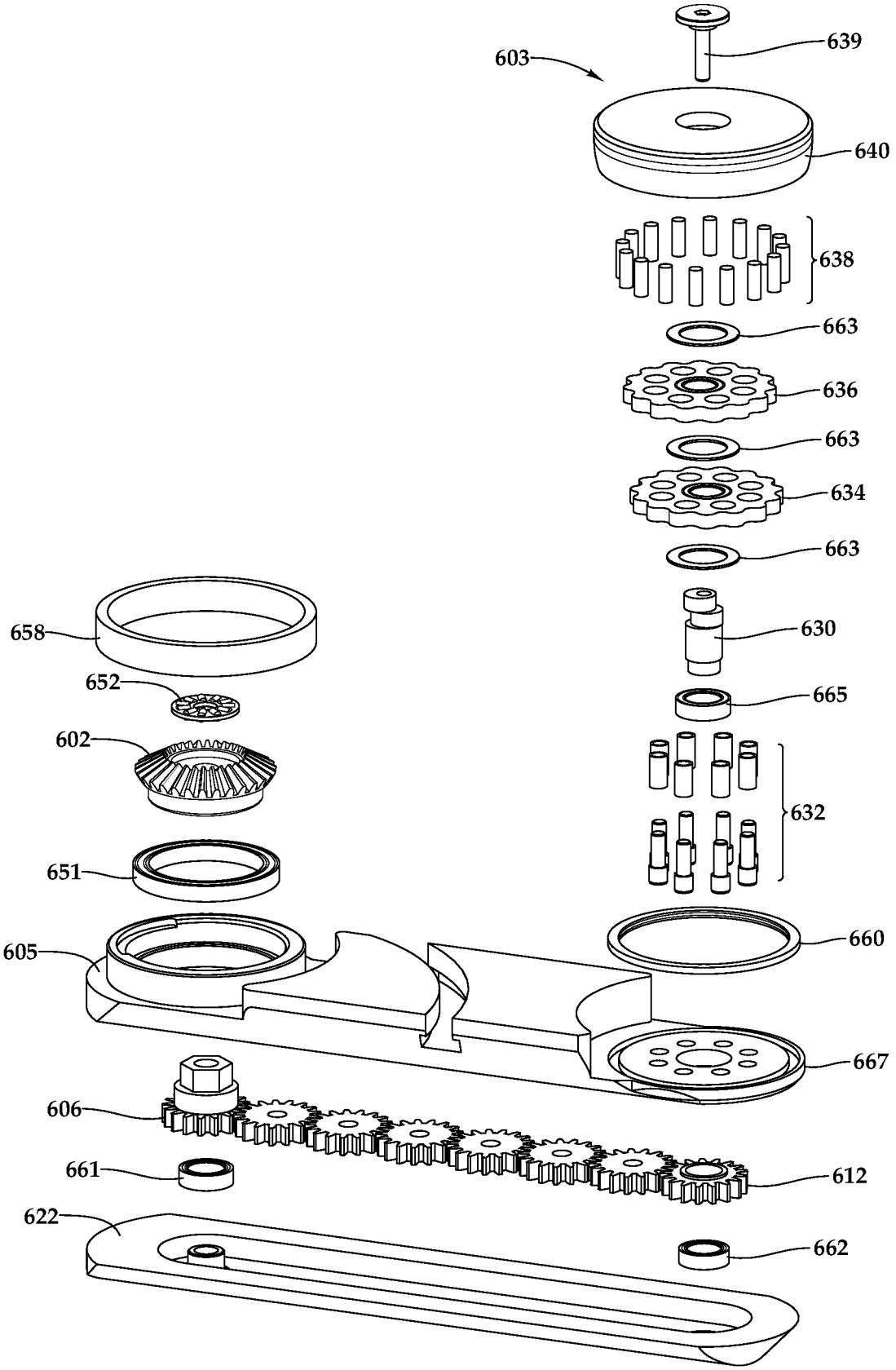
FIG. 6C illustrates an exploded view of the embodiment of conveyance arm as illustrated and described with respect to FIGS. 6A and 6B.

FIG. 6C illustrates an exploded view of the embodiment of conveyance arm 600 as illustrated and described with respect to FIGS. 6A and 6B. As shown in FIG. 6C, a first drive gear 606, a plurality of spur gears 610, and a cycloid drive input gear 612 are positioned in a chain of mechanically coupled gears forming a drivetrain position under chassis 614. Cover 622 is positioned under the chain of gears, and is configured to cover and protect these gears when the conveyance arm is assembled. Bearing 661 is used to rotationally position the first drive gear 606 relative to the cover 622. Bearing 662 is used to rotationally position the cycloid drive input gear 612 relative to cover 622.

At a first end 605 of the chassis 614, a beveled gear 602 is positioned on the shaft extending from the first drive gear 606 and held in place by bearing 652. Ring bearing 651 allows the beveled gear 602 to be rotationally coupled to chassis 614, while ring bearing 653 allows the chassis 614 to be rotationally positioned to a center section of a tool body where the conveyance arm is being utilized.

The cycloid drive 603 is positioned at the second end 607 of chassis 614. The cycloid drive 603 includes sleeves and rolling pins 632, eccentric shaft 630, first cycloid disc 634, second cycloid disc 636, ring pins 638, and drive wheel 640. Drive wheel 640 is held in place by center pin 639, but allowed to rotate at a different rotational speed relative to the eccentric shaft as the drive wheel is driven by the rotation of the eccentric shaft through the eccentric shaft's movements imparted onto the cycloid discs. One or more spacers 663 may be placed on either side of and between the cycloid discs 634 and 636. A bearing 665 is used to rotationally secure the bottom portion of eccentric shaft 630 to chassis 614. A seal 667 is used to allow the drive wheel to rotate relative to the surface of chassis 614 where the outer edges of the drive wheel may come into contact with the chassis and to seal the arm from external wellbore fluids.

Figure 6D:
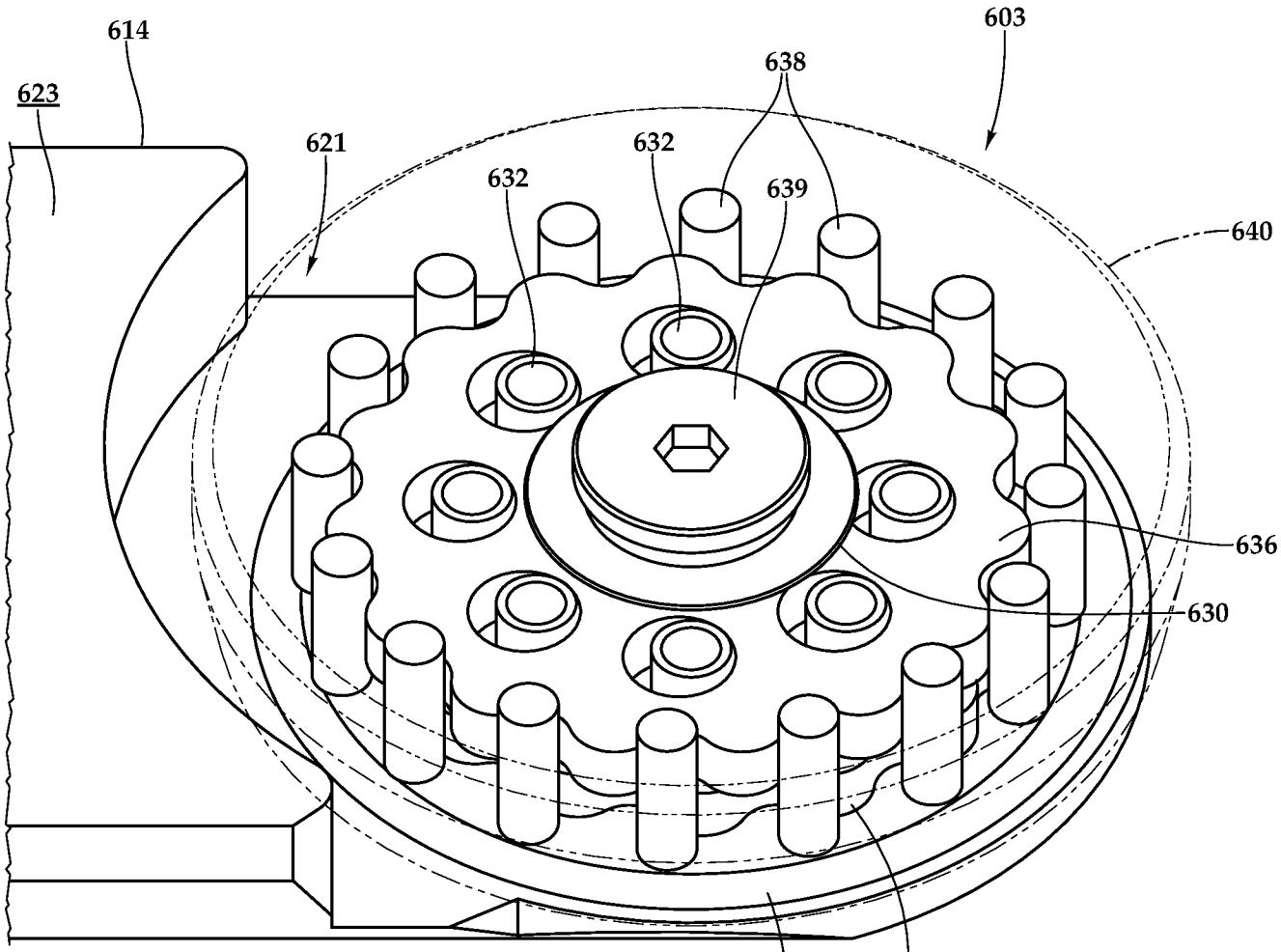
FIG. 6D illustrates a perspective view of the cycloid drive of the conveyance arm 600 of FIGS. 6A and 6B.

FIG. 6D illustrates a perspective view of the cycloid drive 603 of the conveyance arm 600 of FIGS. 6A and 6B. As shown in FIG. 6D, cycloid drive 603 is positioned in a cutaway portion 621 of chassis 614, so that the top of drive wheel 640 does not extend above a top surface 623 of the chassis. This configuration of the cycloid drive 603 and drive wheel 640 allows for a compact design of the cycloid drive 603 in the vertical direction perpendicular to the longitudinal axis of the chassis, and thereby further allows a pair of these conveyance arms to be stacked one above the other, for example within a tool body as illustrated in FIG. 5C.

As further illustrated by the perspective view illustrated in FIG. 6D, rolling pins 632 are shown as extending through the respective central pattern of holes provided in the first cycloid disc 634 and the second cycloid disc 636, and the engagements between the ring pins 638 with the sets of teeth provided around the outer perimeter of both the first cycloid disc and the second cycloid disc are visible. As illustrated in FIG. 6D, in various embodiments the outer surface 641 of drive wheel 640 extends downward over the cycloid discs 634 and 636, and ring pins 638 to a seal 667 positioned in a trough located at the bottom surface of the cutout 621 of chassis 614, thereby allowing for the top surface of the drive wheel 640 to be no higher than the top surface of chassis 614. In various embodiments, the area within cycloid drive 603 that is enclosed by drive wheel 640 and the cutout portion 621 of chassis 614 is configured to be filled and to retain a lubrication fluid, such as oil, for lubrication of the moving parts within the cycloid drive. Other embodiments of the cycloid drive 603 do not require the use of a lubrication fluid to be provided within the cycloid drive.

Figure 6E:
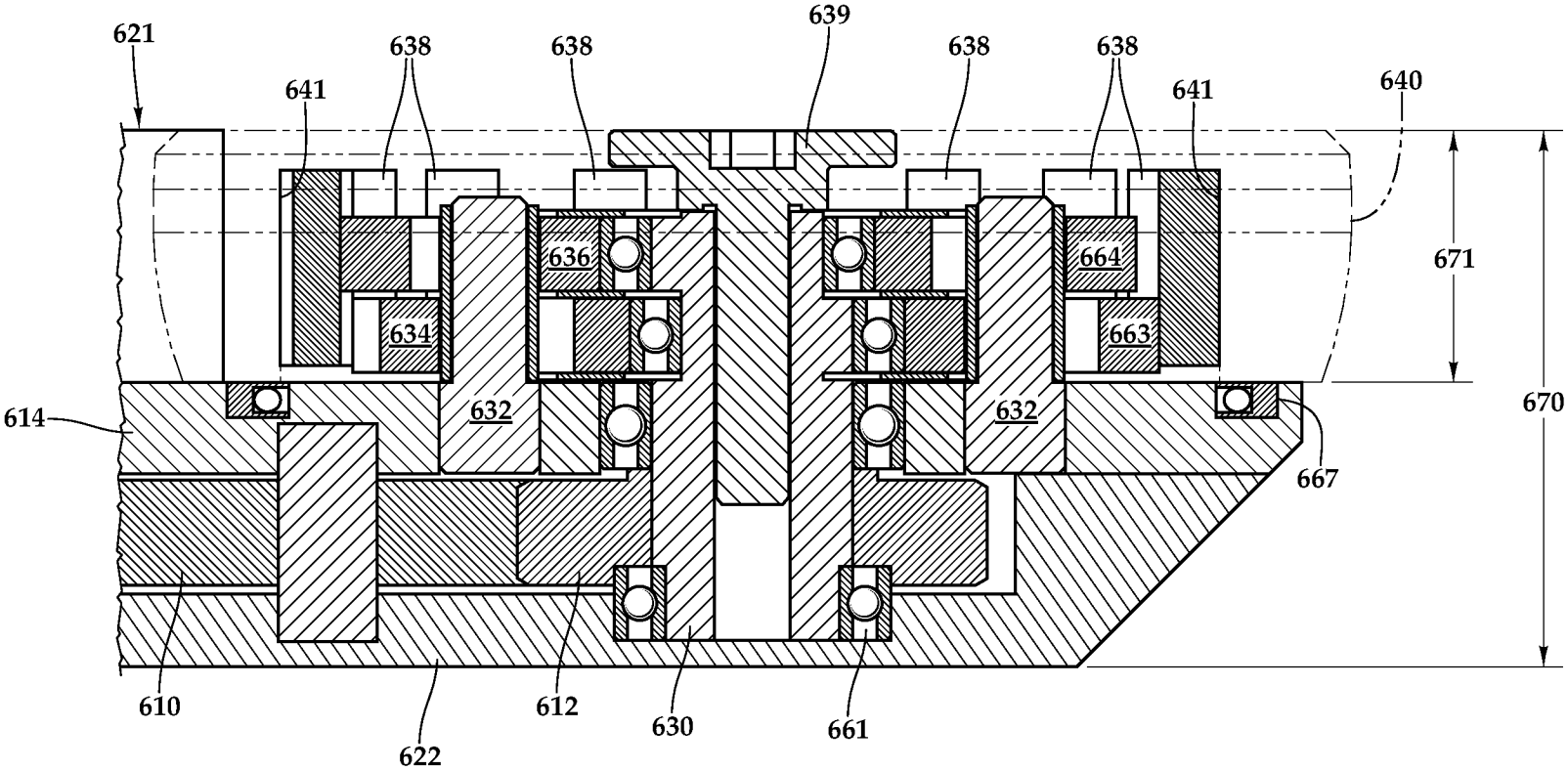
FIG. 6E illustrates a cutaway view of the cycloid drive of a conveyance arm as positioned in a chassis.

FIG. 6E illustrates a cutaway view of the cycloid drive 603 of conveyance arm 600 as positioned in chassis 614. As shown in FIG. 6E, the offset between the center hole of the first cycloid disc 634 and the center hole of the second cycloid disc 636 relative to the positioning of the cycloid discs on the eccentric shaft 630 allows for the wobbling movement of the cycloid discs when the eccentric shaft 630 is rotating, resulting in the "walking" of the teeth of the cycloid discs relative to the ring pins 638, and further resulting in the rotational movement of the ring pins 638, which in turn is transferred as rotational movement of the drive wheel 640 around the center pin 639.

As shown in FIG. 6E, the outside portion of drive wheel 640, including outer surface 641, extends downward over the cycloid discs 634 and 636, and ring pins 638 to a seal 667 positioned in a trough located at the bottom surface of the cutout 621 of chassis 614, thereby allowing for the top surface of the drive wheel 640 to be no higher than the top surface of chassis 614. This arrangement allows for the compact vertical arrangement of the cycloid drive. In various embodiments, a height dimension 670 for the cycloid drive is in a range of from 1.0 to 2.0 inches (2.54 to 5.08 centimeters), inclusive. In various embodiments, a height dimension 671 for the drive wheel 640 is in a range from 0.2 to 1.0 inches (0.508 to 2.54 centimeters), inclusive.

Figure 7:
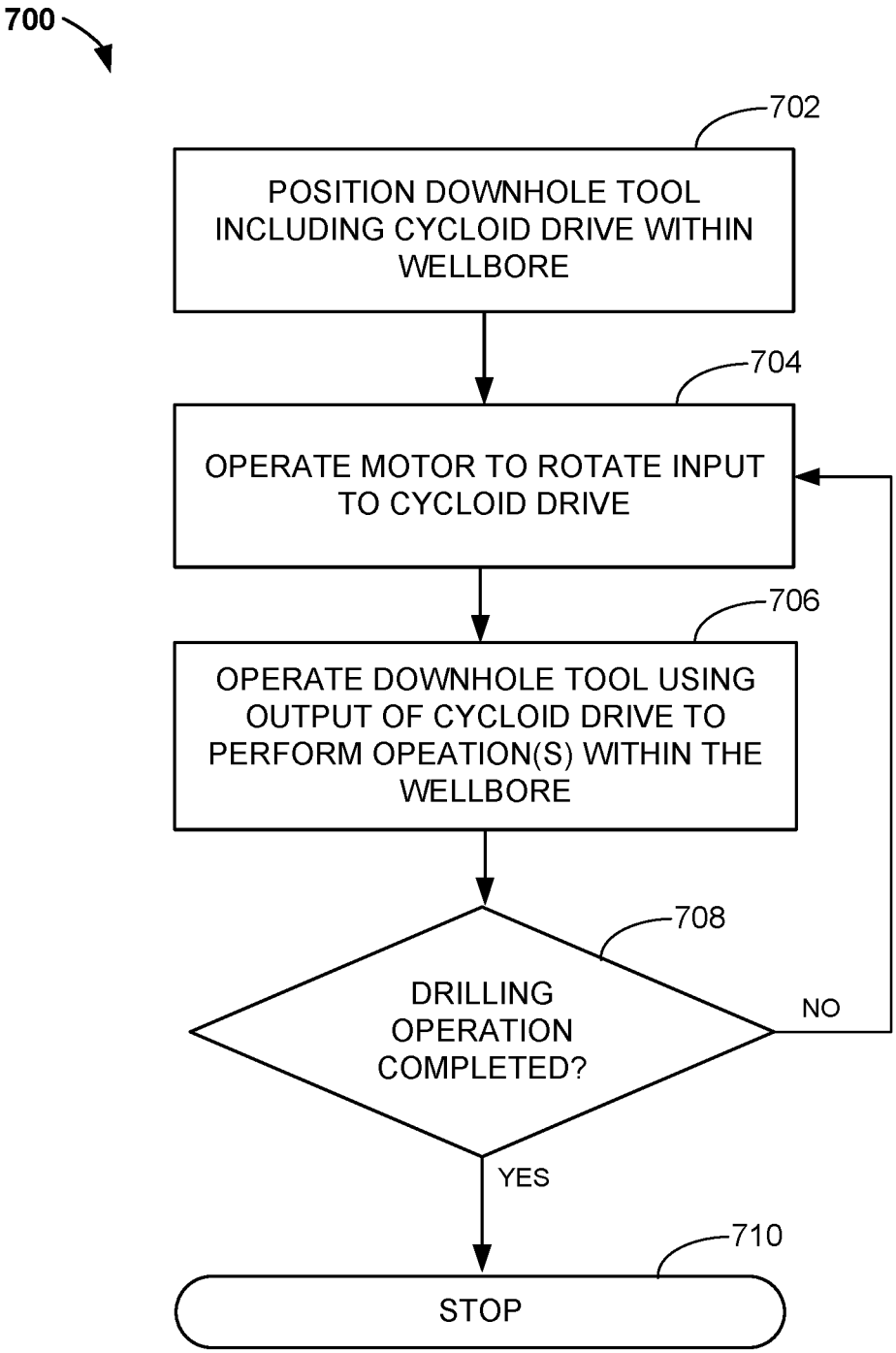
FIG. 7 illustrates a flowchart of a method according to various embodiments.

FIG. 7 illustrates a flowchart of a method 700 according to various embodiments. In various embodiments, method 700 may be performed by some combination of the components illustrated and described above with respect to well system 100 and FIG. 1. In various embodiments, method 700 may be performed using a cycloid drive to operate a drill bit and for performing drilling operations, as illustrated and described above with respect to the downhole tool 200 and FIG. 2. In various embodiments, method 700 may be performed using a cycloid drive to operate a reciprocating tool within a wellbore, such as a ball screw, as illustrated and described above with respect to the downhole tool 300 and FIG. 3.

As shown in FIG. 7, embodiments of method 700 may begin by positioning a downhole tool including a cycloid drive within a wellbore (block 702).

Embodiments of method 700 include operating a motor to rotate the cycloid drive of the downhole tool (block 704).

Embodiments of method 700 include operating a downhole tool or device that is coupled to the output of the cycloid drive in order to perform one or more operations within the wellbore (block 706). In various embodiments, the tool or device coupled to the output of the cycloid drive is a drill bit, and the operation of the cycloid drive is used to rotate the drill bit in order to extend and/or further advance a wellbore through a formation. In various embodiments, the tool or device coupled to the output of the cycloid drive is a reciprocating tool, such as a ball screw apparatus, and wherein the operation of the cycloid drive is used to operate the reciprocating tool in order to perform one or more operations on the wellbore where the tool or device is located.

Embodiments of method 700 include determining whether the drilling operation has been completed (decision block 708). When a determination is made that the drilling operation has not been completed (the "NO" branch extending from decision block 708), method 700 may proceed block 704, including continuing to operate the motor to rotate the input to the cycloid drive, and using the output of the cycloid drive to perform operation(s) on the wellbore.

When a determination is made that the drilling operation has been completed (the "YES" branch extending from decision block 708), method 700 may proceed to stopping the operation of the motor, and thus the operation of the downhole tool coupled to the output of the cycloid drive (block 710).

Figure 8:
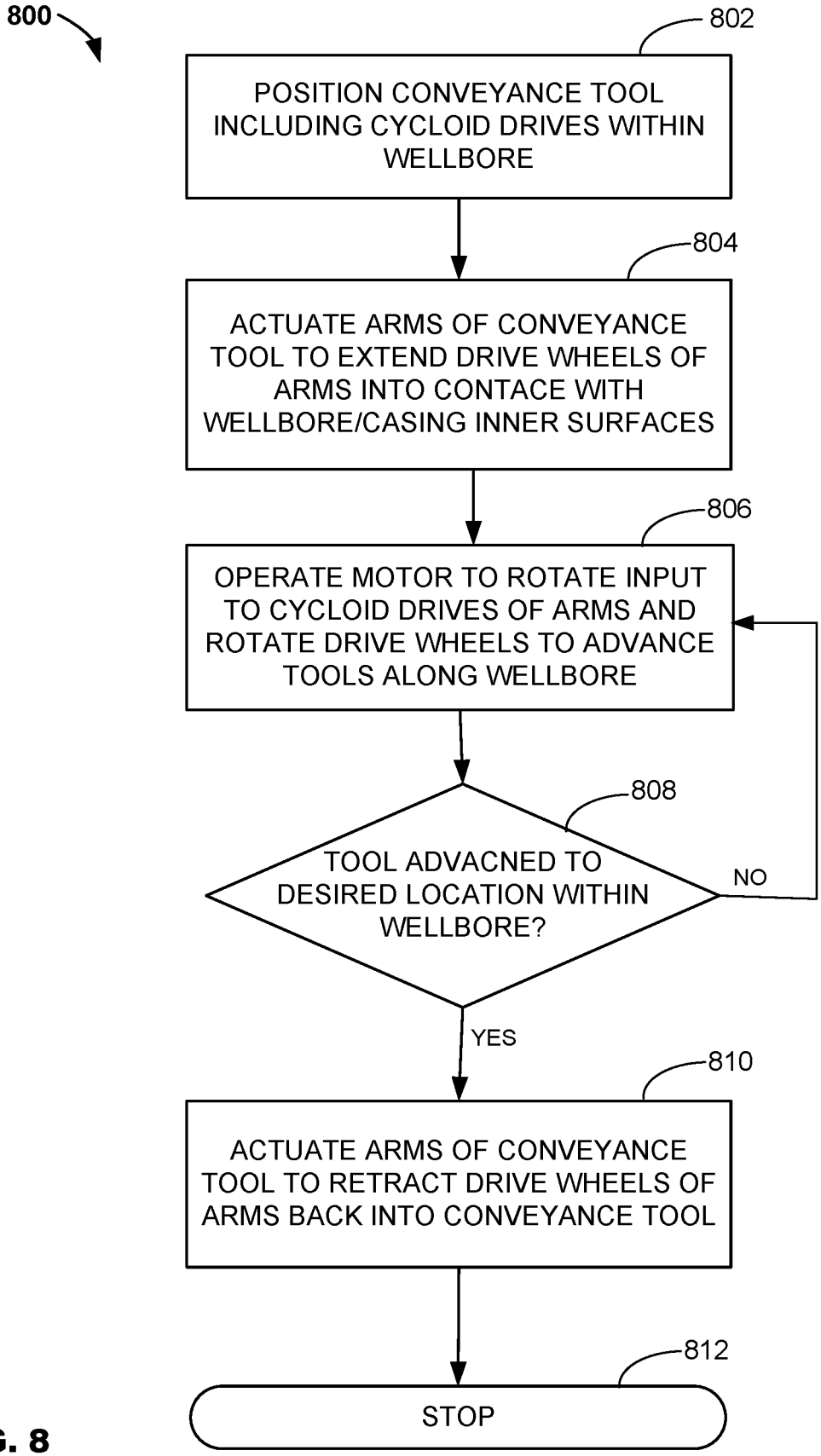
FIG. 8 illustrates a flowchart of a method according to various embodiments.

FIG. 8 illustrates a flowchart of a method 800 according to various embodiments. In various embodiments, method 800 may be performed by some combination of the components illustrated and described above with respect to well system 100 and FIG. 1. In various embodiments, method 800 may be performed using a conveyance tool such as conveyance tool 510 as illustrated and described above with respect to FIGS. 5A-5C, and or using any of the embodiments of the conveyance arms as illustrated and described with respect to FIGS. 6A-6E, or any equivalents thereof.

As shown in FIG. 8, embodiments of method 800 may begin by positioning a conveyance tool including cycloid drives within a wellbore (block 802). In various embodiments, the conveyance tools includes a pair of conveyance arms, each of the conveyance arms having a respective cycloid drive configured to rotate a drive wheel coupled to the output of the cycloid drive, the drive wheels configured to contact an wellbore or an inner surface of a wellbore casing that is adjacent to the location of the conveyance tool, and to be operated to urge the conveyance tool and any downhole tools or other structure that is moveably coupled to the conveyance system to move longitudinally through the wellbore.

Embodiments of method 800 include actuating the conveyance arms of the conveyance tool to extend the drive wheels of the conveyance arms so that the drive wheels come into contact with a wall of the wellbore or an inner surface of a casing of the wellbore that is adjacent to the location of the conveyance tool (block 804). In various embodiments, actuation of the conveyance arms includes actuation of a conveyance arm actuator, such as but not limited to a hydraulic piston, to extend the conveyance arms in order to rotate a first end of each of the conveyance arms around a set of bevel gears coupling the conveyance arms to the tool body of the conveyance tool. In various embodiments, actuating the conveyance arms includes rotating a first end of each of the conveyance arms using a slip joint that allows the first end of the conveyance arm to rotate around until the respective drive wheels located at the opposite end of each of the conveyance arms makes contact with a surface of the wellbore or with an inner surface of a casing extending within the wellbore adjacent to the conveyance arms, and thereafter to maintain a contact pressure between the drive wheels of the extended conveyance arms and the surface of the wellbore or the inner surface of the casing.

Embodiments of method 800 include operating a motor to rotate the inputs to the cycloid drives included in each of the conveyance arms, wherein the cycloid drives in turn rotate the respective drive wheels that are in contact with the wellbore surface or the inner surface of the casing extending through the wellbore in order to advance the conveyance tool in a longitudinal direction through the wellbore (block 806).

Embodiments of method 800 include determining whether the conveyance tool has advanced to the desired position within the wellbore (decision block 808). When a determination is made that conveyance tool has not yet advanced to the desired position within the wellbore, (the "NO" branch extending from decision block 808), method 800 may proceed block 806, including continuing to operate the motor to rotate the input to the cycloid drives, allowing the drive wheels of the conveyance tool to continue to move the conveyance tool along the wellbore.

When a determination is made that the conveyance tool has reached the desired position within the wellbore, (the "YES" branch extending from decision block 808), method 800 may proceed to block 810.

At block 810, embodiment of method 800 include actuating the conveyance arm actuator of the conveyance tool to retract the conveyance arms and the drive wheels back into the tool body of the conveyance tool. Actuation of the conveyance arm actuator in order to retract the conveyance arms back into the tool body of the conveyance tool in various embodiments includes actuation of the conveyance arm actuator, such as but not limited to the hydraulic piston, to retract the conveyance arms in order to rotate a first end of each of the conveyance arms around the set of bevel gears coupling the conveyance arms to the tool body of the conveyance tool in a direction of rotation that is opposite the direction of rotation used to extend the conveyance arms to the extended position.

Upon completion of the retraction of the conveyance arms back into the tool body of the conveyance tool, embodiments of method 800 may proceed to stopping the operation of the motor, and thus the operation of the conveyance tool (block 812).

Figure 9:
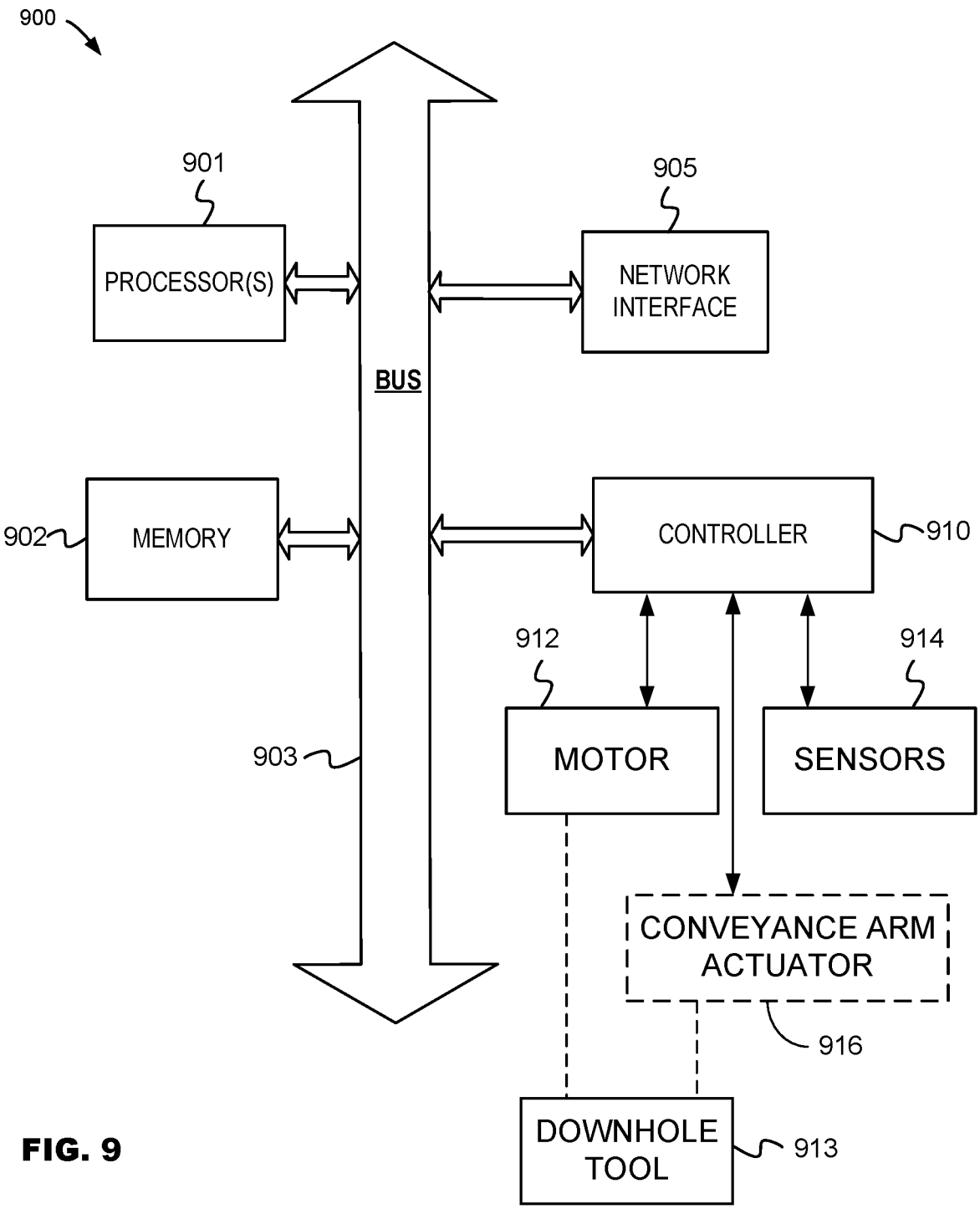
FIG. 9 illustrates a block diagram of an example computing system that may be employed to practice the concepts, methods, and techniques as disclosed herein, and variations thereof.

FIG. 9 illustrates a block diagram of an example computer system 900 that may be employed to practice the concepts, methods, and techniques as disclosed herein, and variations thereof. Computing system 900 includes a plurality of components of the system that are in electrical communication with each other, in some examples using a bus 903. Embodiments of computing system 900 may include any suitable computer, controller, or data processing apparatus capable of being programmed to carry out the methods and for controlling apparatus as further described herein. In various embodiments, one or more components illustrated and described with respect to computing system 900 may be included in user interface 150 as illustrated and described above with respect to FIG. 1. In various embodiments, one or more components illustrated and described with respect to computing system 900 may be included in a bottom hole assembly, such as BHA 104 (controller 144, FIG. 1), or otherwise configured to be positioned downhole within a wellbore.

Referring back to FIG. 9, computing system 900 may be a general-purpose computer, and includes a processor 901 (possibly including multiple processors, multiple cores, multiple nodes, and/or implementing multi-threading, etc.). The computer system 900 includes memory 902. The memory 902 may be system memory (e.g., one or more of cache, SRAM, DRAM, zero capacitor RAM, Twin Transistor RAM, eDRAM, EDO RAM, DDR RAM, EEPROM, NRAM, RRAM, SONOS, PRAM, etc.) or any one or more of the possible realizations of machine-readable media configured to store data and/or program instructions in an electronic format. The computer system also includes the bus 903 (e.g., PCI, ISA, PCI-Express, HyperTransport® bus, InfiniBand® bus, NuBus, etc.) and a network interface 905 (e.g., a Fiber Channel interface, an Ethernet interface, an internet small computer system interface, SONET interface, wireless interface, etc.). Bus 903 may be configured to provide communications between any of the devices included in computing system 900. Network interface 905 may be configured to provide communications between computing system 900 and other computing devices.

Embodiments of computer system 900 include a controller 910. The controller 910 may be configured to control the different operations that can occur in the response inputs from sensors 914 and/or calculations based on inputs from sensors 914 (such as sensors located in or at a drill bit assembly or other downhole tools), using any of the techniques described herein, and any equivalents thereof, to control motor 912. For example, the controller 910 may communicate motor control signals to the appropriate equipment, devices, such as motor control circuitry etc., to thereby control the operation of motor 912. Motor 912 may be mechanically coupled to one or more downhole devices that include a cycloidal drive mechanically coupled to the motor, and having an input driven by or mechanically coupled through one or more devices to the motor shaft in order to allow the motor to control the rotation speed, direction, and the level of rotational torque provided by the mechanical output of the cycloidal drive. In embodiments that include a conveyance tool having extendable and retractable conveyance arms, controller 910 may be configured to control a conveyance arm actuator 916, is configured to control the extension and retraction of the conveyance arms included as part of the downhole tool 913. In various embodiments, the conveyance arm actuator may be a hydraulically controlled piston, such as but not limited to piston 570 as illustrated and described above with respect to FIG. 5A.

Referring again to FIG. 9, any one of the previously described functionalities for control of motor 912 and/or control of conveyance arm actuator 916 may be partially (or entirely) implemented in hardware and/or on the processor 901. For example, the functionality may be implemented with an application specific integrated circuit, in logic implemented in the processor 901, in a co-processor on a peripheral device or card, etc. Further, realizations may include fewer or additional components not illustrated in FIG. 9 (e.g., audio cards, additional network interfaces, peripheral devices, etc.). As illustrated in FIG. 9, the processor 901 and the network interface 905 are coupled to the bus 903. Although illustrated as also being coupled to the bus 903, the memory 902 may be coupled to the processor 901 only, or both processor 901 and bus 903.

As shown in FIG. 9, controller 910 is coupled to one or more sensors 914. The one or more sensors 914 includes sensor(s) located at or within a downhole tool, or at or within a bottom hole assembly such as sensors positioned within BHA 104 (FIG. 1). Controller 910 is configured to receive sensor output signals, such as electrical and/or optical signals, as provided as an output from the sensor(s) 914. In various embodiments, controller 910 may be configured to perform signal processing, such as analog-to-digital signal processing on the received sensor output signals, and to provide the processed sensor output signals to processor 901 and/or to memory 902 via bus 903. Sensor(s) 914 may include any of the sensors associated with sensing one or more parameters associated with or in the areas proximate to the downhole tool(S) included as part of a bottom hole assembly that includes computing system 900. Controller 910 may include circuitry, such as analog-to-digital (A/D) converters and buffers that allow controller 910 to receive electrical signals directly from one or more of sensors 914.

Processor 901 may be configured to execute instructions that provide control signals configured for use by controller 910 to control motor 912 and/or conveyance arm actuator 916 used to operate any of the downhole tools 913 as described in this disclosure, and any equivalents thereof. The controller 910 as shown in FIG. 9 may provide control output signals to control the operation of motor 912, such as the rotational speed, direction, and level of torque provided by motor 912, in order to control downhole tool that include one or more cycloidal device(s) coupled to the motor and utilized to perform one or more operations within a wellbore. The controller 910 may provide control output signal to control the operation of conveyance arm actuator 916 in order to control the extension and retraction of the conveyance arms included as part of a conveyance tool.

In some examples, memory 902 includes non-volatile memory and can be a hard disk or other types of computer readable media which can store data and program instructions that are accessible by a computer, such as magnetic cassettes, flash memory cards, solid state memory devices, digital versatile disks (DVDs), cartridges, RAM, ROM, a cable containing a bit stream, and hybrids thereof.

It will be understood that one or more blocks of the flowchart illustrations and/or block diagrams, and combinations of blocks in the flowchart illustrations and/or block diagrams, can be implemented by program code. The program code may be provided to a processor of a general-purpose computer, special purpose computer, or other programmable machine or apparatus. As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine. While depicted as a computing system 900 or as a general purpose computer, some embodiments can be any type of device or apparatus to perform operations described herein.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine readable medium(s) may be utilized. The machine readable medium may be a machine readable signal medium or a machine readable storage medium. A machine readable storage medium may be, for example, but not limited to, a system, apparatus, or device, which employs any one of or combination of electronic, magnetic, optical, electromagnetic, infrared, or semiconductor technology to store program code. More specific examples (a non-exhaustive list) of the machine readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine readable storage medium may be any tangible medium that can contain, or store a program for use by or in connection with an instruction execution system, apparatus, or device. A machine readable storage medium is not a machine readable signal medium.

While the aspects of the disclosure are described with reference to various implementations and exploitations, it will be understood that these aspects are illustrative and that the scope of the claims is not limited to them. In general, techniques for controlling drilling operations based at least in part on output signals provided by one or more sensors located at or within a drill bit assembly as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

Example embodiments include the following.

Embodiment 1. An apparatus comprising: a conveyance tool comprising a first conveyance arm and a second conveyance arm, wherein the first conveyance arm includes a first cycloid drive comprising a first drive wheel, the first cycloid drive configured to rotate the first drive wheel when an input to the first cycloid drive is rotated, wherein the second conveyance arm includes a second cycloid drive comprising a second drive wheel, the second cycloid drive configured to rotate the second drive wheel when and input to the second drive is rotated, and wherein the first drive wheel and the second drive wheel are configured to engage a surface within a wellbore and to exert a force on the conveyance tool, the force configured to move the conveyance tool longitudinally through the wellbore when the first drive wheel and the second drive wheel are being rotated.

Embodiment 2. The apparatus of embodiment 1, further comprising: a motor having a motor output shaft coupled to both a first bevel gear of the first conveyance arm and a second bevel gear of the second conveyance arm, the motor configured to rotate the motor output shaft and in turn rotate both the first bevel gear and the second bevel gear.

Embodiment 3. The apparatus of embodiment 2, wherein the first bevel gear to is couple to the input of the first cycloid drive by a first set of spur gears and the second bevel gear is coupled to the input of the second cycloid drive by a second set of spur gears, and wherein the motor is configured to rotate the output shaft coupled to both the first bevel gear and the second bevel gear, causing the first bevel gear to rotate the input of the first cycloid drive through the first set of spur gears, and causing the second bevel gear to rotate the input to the second cycloid drive through the second set of spur gears. 1. Embodiment 4. The apparatus of embodiment 1, further comprising: a piston coupled to the first conveyance arm and to the second conveyance arm, wherein the first conveyance arm and the second conveyance are configured to extend the first drive wheel and the second drive wheel to engage the surface within the wellbore when the piston is actuated to move in a first direction, and to retract the first drive wheel and the second drive wheel when the piston is actuated to move in a second direction.

Embodiment 5. The apparatus of any one of embodiments 1-4, wherein the first cycloid drive and the second cycloid drive each provide a rotational reduction ratio in a range from 6:1 to 30:1, inclusive.

Embodiment 6. The apparatus of any one of embodiments 1-5, wherein the first cycloid drive and the second cycloid drive have a maximum thickness dimension in a range from 1.0 to 2.0 inches, inclusive.

Embodiment 7. The apparatus of any one of embodiments 1-6, wherein each of the first cycloid drive and the second cycloid drive includes a first cycloid disc and a second cycloid disc coupled to an eccentric shaft.

Embodiment 8. The apparatus of any one of embodiments 1-9, wherein the first drive wheel and the second drive wheel are formed from a metal alloy.

Embodiment 9. The apparatus of any one of embodiments 1-8, wherein the first conveyance arm includes a first chassis configured to allow rotation of the first conveyance arm to extend the first conveyance arm at a first angle away from a longitudinal axis of the conveyance tool, and wherein the second conveyance arm includes a second chassis configured to allow rotation of the second conveyance arm to extend the second conveyance arm at a second angle away from the longitudinal axis of the conveyance tool and on an opposite side of the longitudinal axis.

Embodiment 10. An apparatus comprising: a downhole tool including a cycloidal drive coupled to a drill bit, the cycloid drive configured to rotate the drill bit when a drive input to the cycloid drive is rotated, wherein the cycloid drive is configured to provide a rotational speed of the drill bit that is less than a rotational speed being provided to an input of the cycloidal drive.

Embodiment 11. The apparatus of embodiment 10, wherein the cycloid drive includes a first cycloid disc coupled to an eccentric shaft and a second cycloid disc coupled to the eccentric shaft, the first cycloid disc and the second cycloid disc receiving a plurality of rolling pins at respective sets of holes extending through the first cycloid disc and the second cycloid disc, wherein the rolling pins are configured to be rotated when the drive input to the cycloid drive is rotated, and wherein the rotational motion of the rolling pins is transferred as rotational motion imparted to an output disc or hub through the rolling pins.

Embodiment 12. The apparatus of embodiment 11, further comprising: a first set of teeth extending around an outer perimeter of the first cycloid disc; and a second set of teeth extending around an outer perimeter of the second cycloid disc; wherein the first set of teeth and the second set of teeth are configured to engage a stationary set of ring pins which allow the first cycloid disc and the second cycloid disc to rotate around when driven by the eccentric shaft and to thereby rotate the rolling pins.

Embodiment 13. The apparatus of any one of embodiments 10-12, wherein the cycloid drive provides a rotational reduction rate in a range from 6:1 to 216:1, inclusive.

Embodiment 14. The apparatus of any one of embodiments 10-13, wherein the cycloid drive provides a torque multiplication in a range of 6 to 216 times, inclusive, between an input drive and an output of the cycloid drive.

Embodiment 15. A method comprising: positioning a downhole tool within a wellbore, the downhole tool including at least one cycloid drive; operating a motor coupled to the at least one cycloid drive to rotate an input to the at least one cycloid drive; and rotating at least one device coupled to an output of the at least one cycloid drive in order to perform at least one wellbore operation on the wellbore.

Embodiment 16. The method of embodiment 15, wherein the at least one device comprises a drill bit.

Embodiment 17. The method of embodiment 16, wherein the at least one wellbore operation includes a drilling operation configured to advancing the wellbore through a formation using the drill bit.

Embodiment 18. The method of any one of embodiments 15-17, wherein the at least one device include a reciprocating tool.

Embodiment 19. The method of any one of embodiments 15-18, wherein the downhole tool comprises a conveyance tool having a first conveyance arm and a second conveyance arm, the first conveyance arm including a first cycloid drive of the at least one cycloid drive, the first cycloid drive comprising a first drive wheel, the first cycloid drive configured to rotate the first drive wheel when an input to the first cycloid drive is rotated, the second conveyance arm including a second cycloid drive of the at least one cycloid drive, the second cycloid drive comprising a second drive wheel, the second cycloid drive configured to rotate the second drive wheel when and input to the second drive is rotated.

Embodiment 20. The method of embodiment 19, further comprising: extending the first conveyance arm and the second conveyance arm to that the first drive wheel and the second drive wheel engage a surface within the wellbore and rotating the first drive wheel and the second drive wheel in order to exert a force on the conveyance tool against the surface within the wellbore to move the conveyance tool longitudinally through the wellbore.

What is claimed is:

1. An apparatus comprising:

a conveyance tool comprising a first conveyance arm and a second conveyance arm, the first conveyance arm and the second conveyance arm coupled to a tool body of the conveyance tool at a beveled gearbox, the first conveyance arm and the second conveyance arm configured to be positioned in a retracted position within the tool body such that the first conveyance arm is stacked above and aligned with the second conveyance arm, having a longitudinal axis of the first conveyance arm and a longitudinal axis of the second conveyance arm aligned with a longitudinal axis of the conveyance tool, wherein the first conveyance arm includes a first cycloid drive comprising a first drive wheel, the first cycloid drive configured to rotate the first drive wheel when a first bevel gear of the first conveyance arm positioned within the beveled gearbox is rotated, wherein the second conveyance arm includes a second cycloid drive comprising a second drive wheel, the second cycloid drive configured to rotate the second drive wheel when a second bevel gear of the second conveyance arm positioned within the beveled gearbox is rotated, and wherein the first drive wheel and the second drive wheel are configured to engage a surface within a wellbore and to exert a force on the conveyance tool, the force configured to move the conveyance tool longitudinally through the wellbore when the first drive wheel and the second drive wheel are being rotated; and a single motor positioned within the tool body and having a motor output shaft coupled to both the first bevel gear of the first conveyance arm and the second bevel gear of the second conveyance arm, the first bevel gear and the second bevel gear located one above the other within the beveled gearbox, and the motor configured to rotate the motor output shaft and in turn rotate both the first bevel gear and the second bevel gear through a single pinion gear coupled to the motor output shaft.

2. The apparatus of claim 1, wherein the first bevel gear is coupled to an input of the first cycloid drive by a first set of spur gears and the second bevel gear is coupled to an input of the second cycloid drive by a second set of spur gears, and wherein the rotation of the single pinion gear by the motor is configured to rotate both the first bevel gear and the second bevel gear, causing the first bevel gear to rotate the input of the first cycloid drive through the first set of spur gears, and causing the second bevel gear to rotate the input to the second cycloid drive through the second set of spur gears.

3. The apparatus of claim 1, further comprising:

a piston coupled to the first conveyance arm and to the second conveyance arm, wherein the first conveyance arm and the second conveyance are configured to extend the first drive wheel and the second drive wheel to engage the surface within the wellbore when the piston is actuated to move in a first direction, and to retract the first drive wheel and the second drive wheel when the piston is actuated to move in a second direction.

4. The apparatus of claim 1, wherein the first cycloid drive and the second cycloid drive each provide a rotational reduction ratio in a range from 6:1 to 30:1, inclusive.

5. The apparatus of claim 1, wherein the first cycloid drive and the second cycloid drive have a maximum thickness dimension in a range from 1.0 to 2.0 inches, inclusive.

6. The apparatus of claim 1, wherein each of the first cycloid drive and the second cycloid drive includes a first cycloid disc and a second cycloid disc coupled to an eccentric shaft.

7. The apparatus of any claim 1, wherein the first drive wheel and the second drive wheel are formed from a metal alloy.

8. The apparatus of claim 1, wherein the first conveyance arm includes a first chassis configured to allow rotation of the first conveyance arm to extend the first conveyance arm at a first angle away from a longitudinal axis of the conveyance tool, and wherein the second conveyance arm includes a second chassis configured to allow rotation of the second conveyance arm to extend the second conveyance arm at a second angle away from the longitudinal axis of the conveyance tool and on an opposite side of the longitudinal axis.

9. A method comprising:

positioning a downhole tool within a wellbore by operating a conveyance tool comprising a first conveyance arm and a second conveyance arm, the first conveyance arm and the second conveyance arm coupled to a tool body of the conveyance tool at a beveled gearbox, the first conveyance arm and the second conveyance arm positioned initially in a retracted position within the tool body such that the first conveyance arm is stacked above and aligned with the second conveyance arm, having a longitudinal axis of the first conveyance arm and a longitudinal axis of the second conveyance arm aligned with a longitudinal axis of the conveyance tool, wherein the first conveyance arm includes a first cycloid drive including a first drive wheel, the first cycloid drive configured to rotate the first drive wheel when a first bevel gear of the first conveyance arm positioned within the beveled gearbox is rotated, wherein the second conveyance arm includes a second cycloid drive including the second drive wheel, the second cycloid drive configured to rotate the second drive wheel when a second bevel gear of the second conveyance arm positioned within the beveled gearbox is rotated, and wherein the conveyance tool further includes a single motor positioned within the tool body and having a motor output shaft coupled to both the first bevel gear of the first conveyance arm and the second bevel gear of the second conveyance arm, the first bevel gear and the second bevel gear located one above the other within the beveled gearbox, and the motor configured to rotate the motor output shaft and in turn rotate both the first bevel gear and the second bevel gear through a single pinion gear coupled to the motor output shaft;

actuating the first conveyance arm and the second conveyance arm to extend the first drive wheel of the first conveyance arm and the second drive wheel of the second conveyance arm to come into contact with a wall of the wellbore or an inner surface of a casing of the wellbore; and operating the single motor in order to the rotate the first drive wheel of the first conveyance arm through the first bevel gear and to rotate the second drive wheel of the second conveyance arm through the second bevel gear while both the first drive wheel and the second drive wheel are extended to contact the wall of the wellbore or the inner surface of the casing of the wellbore, wherein the rotation of the first drive wheel and the rotation of the second drive wheel when in contact with the wall of the wellbore or the inner surface of the casing of the wellbore exert a force on the conveyance tool, the force moving the conveyance tool and the downhole tool longitudinally through the wellbore.

10. The method of claim 9, wherein the downhole tool comprises a drill bit.

11. The method of claim 9, further comprising:

moving the downhole tool, using the conveyance tool, to a desired location within the wellbore, and performing at least one wellbore operation within the wellbore using the downhole tool while positioned at the desired location within the wellbore.

12. The method of claim 11, wherein the at least one wellbore operation includes a drilling operation to advance the wellbore through a formation using a drill bit.

13. The method of claim 12, wherein the downhole tool comprises a bottom-hole-assembly including one or more sensors configured to sense one or more physical parameters associated with the wellbore.

14. The method of claim 9, wherein the downhole tool comprises a reciprocating tool.

* * * * *